US007188799B1

(12) United States Patent
Lindsay et al.

(10) Patent No.: US 7,188,799 B1
(45) Date of Patent: Mar. 13, 2007

(54) DISPENSING SYSTEM FOR WIPES

(75) Inventors: Jeff Lindsay, Appleton, WI (US); Herb F. Velazquez, Neenah, WI (US); William Robert Newman, Neenah, WI (US); Michael John Faulks, Neenah, WI (US); Paige Annette Dellerman, Appleton, WI (US); Ligia A. Rivera, Appleton, WI (US); Jennifer Cappel Larson, Oshkosh, WI (US); Cherry A. Bochmann, Lakewood, OH (US); Gerald P. DeGreen, Windsor, OH (US); Nick E. Stanca, Westlake, OH (US); Jeffrey M. Kalman, Cleveland Heights, OH (US); Yung Hsiang Huang, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 1196 days.

(21) Appl. No.: 09/659,306

(22) Filed: Sep. 12, 2000

Related U.S. Application Data

(63) Continuation-in-part of application No. 09/565,227, filed on May 4, 2000, now Pat. No. 6,705,565, which is a continuation-in-part of application No. 09/545,995, filed on Apr. 10, 2000, now Pat. No. 6,626,395.

(60) Provisional application No. 60/132,024, filed on Apr. 30, 1999.

(51) Int. Cl.
*B65H 16/06* (2006.01)
*B65H 18/04* (2006.01)

(52) U.S. Cl. ..... 242/598.6

(58) Field of Classification Search ..... 242/598.6, 242/598, 598.3, 598.5, 596.8, 579, 580, 580.1, 242/598.2

See application file for complete search history.

(56) References Cited

U.S. PATENT DOCUMENTS

| | | | |
|---|---|---|---|
| 714,963 | A | 12/1902 | Steinkamp |
| 1,003,995 | A | 9/1911 | Denoon, Jr. |
| 1,272,598 | A | 7/1918 | Baker |
| 1,664,392 | A | 4/1928 | Baruch |

(Continued)

FOREIGN PATENT DOCUMENTS

| | | |
|---|---|---|
| DE | 3840937 | 4/1990 |

(Continued)

OTHER PUBLICATIONS

Derwent World Patent Database abstract of DE 3133237: Description of M. Scheepe, "Refill Pack of Moisture-Impregnated Tissues."

(Continued)

*Primary Examiner*—Emmanuel M Marcelo
(74) *Attorney, Agent, or Firm*—Brinks Hofer Gilson & Lione

(57) ABSTRACT

There is provided a system and apparatus for dispensing wet wipes. The system may include a housing, a tray and a cartridge, and a wiper blade. The cartridge may have the ability to be inserted into the dispenser in a pre-selected manner based on the desired orientation of the wipes contained therein. The wiper blade may have the ability to control the dispensing characteristics of the wet wipes.

30 Claims, 28 Drawing Sheets

U.S. PATENT DOCUMENTS

| | | | |
|---|---|---|---|
| 2,182,831 | A | 12/1939 | Wagner |
| 2,422,749 | A | 6/1947 | Rougas |
| D148,484 | S | 1/1948 | Roche |
| 2,440,974 | A | 5/1948 | Resch |
| 2,487,763 | A | 11/1949 | Patterson et al. |
| 2,561,584 | A | 7/1951 | McDonald |
| 2,606,724 | A | 8/1952 | Hertz |
| 2,805,030 | A | 9/1957 | Wolters |
| 3,291,411 | A | 12/1966 | Krueger et al. |
| 3,310,353 | A | 3/1967 | Cordis |
| 3,368,522 | A | 2/1968 | Cordis |
| 3,467,330 | A | 9/1969 | Yavitch |
| 3,532,210 | A | 10/1970 | Minion et al. |
| 3,568,635 | A | 3/1971 | Poitras et al. |
| 3,592,161 | A | 7/1971 | Hoffmann |
| 3,603,519 | A | 9/1971 | Brown |
| 3,633,838 | A | 1/1972 | Krueger |
| 3,656,699 | A | 4/1972 | Schnyder et al. |
| 3,713,170 | A | 1/1973 | Kaufman |
| 3,729,145 | A | 4/1973 | Koo et al. |
| 3,754,804 | A | 8/1973 | Cushman |
| 3,756,483 | A | 9/1973 | Schraeder |
| 3,771,739 | A | 11/1973 | Nelson |
| 3,775,801 | A | 12/1973 | Walker |
| 3,780,908 | A | 12/1973 | Fitzpatrick et al. |
| 3,784,055 | A | 1/1974 | Anderson |
| 3,788,573 | A | 1/1974 | Thomson et al. |
| 3,795,355 | A | 3/1974 | Gerstein |
| 3,799,467 | A | 3/1974 | Bauman |
| 3,806,055 | A | 4/1974 | Bauman |
| 3,824,953 | A | 7/1974 | Boone |
| 3,836,044 | A | 9/1974 | Tilp et al. |
| 3,836,045 | A | 9/1974 | Duhy et al. |
| 3,837,595 | A | 9/1974 | Boone |
| 3,841,466 | A | 10/1974 | Hoffman et al. |
| 3,843,017 | A | 10/1974 | Harrison |
| 3,848,822 | A | 11/1974 | Boone |
| 3,865,271 | A | 2/1975 | Gold |
| 3,868,052 | A | 2/1975 | Rockerfeller |
| 3,870,211 | A | 3/1975 | Schriever |
| 3,890,622 | A | 6/1975 | Alden |
| 3,913,522 | A | 10/1975 | Light |
| 3,943,859 | A | 3/1976 | Boone |
| 3,949,947 | A | 4/1976 | Youngquist et al. |
| 3,967,756 | A | 7/1976 | Barish |
| 3,970,215 | A | 7/1976 | McLaren et al. |
| 3,973,695 | A | 8/1976 | Ames |
| 3,982,659 | A | 9/1976 | Ross |
| 3,986,479 | A | 10/1976 | Bonk |
| 3,994,417 | A | 11/1976 | Boedecker |
| 3,995,582 | A | 12/1976 | Douglas |
| 4,002,264 | A | 1/1977 | Marchesani |
| 4,004,687 | A | 1/1977 | Boone |
| 4,025,004 | A | 5/1977 | Massey |
| 4,043,519 | A | 8/1977 | Suzuki et al. |
| 4,069,789 | A | 1/1978 | Fukagawa et al. |
| 4,071,200 | A | 1/1978 | Stone |
| 4,098,469 | A | 7/1978 | McCarthy |
| 4,101,026 | A | 7/1978 | Bonk |
| 4,106,433 | A | 8/1978 | Fernando et al. |
| 4,106,616 | A | 8/1978 | Boone |
| 4,106,617 | A | 8/1978 | Boone |
| D249,604 | S | 9/1978 | Woo |
| 4,114,824 | A | 9/1978 | Danielak |
| 4,124,259 | A | 11/1978 | Harris |
| 4,131,195 | A | 12/1978 | Worrell, Sr. |
| 4,135,199 | A | 1/1979 | Kurland et al. |
| 4,135,678 | A | 1/1979 | Williams |
| 4,138,034 | A | 2/1979 | McCarthy |
| 4,179,078 | A | 12/1979 | Mansfield |
| 4,191,317 | A | 3/1980 | Harkins |
| 4,205,802 | A | 6/1980 | Economakis |
| 4,219,129 | A | 8/1980 | Sedgwick |
| 4,222,621 | A | 9/1980 | Greenlee et al. |
| 4,235,333 | A | 11/1980 | Boone |
| 4,238,541 | A | 12/1980 | Burton |
| 4,244,493 | A | 1/1981 | Harrison |
| 4,260,117 | A | 4/1981 | Perrin et al. |
| 4,272,473 | A | 6/1981 | Riemersma et al. |
| 4,274,573 | A | 6/1981 | Finkelstein |
| 4,280,978 | A | 7/1981 | Dannheim et al. |
| 4,294,389 | A | 10/1981 | Falk et al. |
| 4,328,907 | A | 5/1982 | Beard |
| 4,353,480 | A | 10/1982 | McFadyen |
| 4,363,454 | A | 12/1982 | Mohar |
| 4,375,874 | A | 3/1983 | Leotta et al. |
| 4,383,656 | A | 5/1983 | Campbell |
| 4,401,248 | A | 8/1983 | Helms |
| 4,411,374 | A | 10/1983 | Hotchkiss |
| 4,425,012 | A | 1/1984 | Kley |
| 4,427,159 | A | 1/1984 | Miller et al. |
| 4,428,497 | A | 1/1984 | Julius et al. |
| 4,432,504 | A | 2/1984 | Pace |
| 4,436,221 | A | 3/1984 | Margulies |
| 4,447,015 | A | 5/1984 | Peterson |
| 4,453,634 | A | 6/1984 | Blumenthal |
| 4,463,912 | A | 8/1984 | Grunerud |
| 4,467,974 | A | 8/1984 | Crim |
| 4,526,291 | A | 7/1985 | Margulies |
| 4,535,912 | A | 8/1985 | Bonk |
| 4,550,855 | A | 11/1985 | Harrison |
| 4,564,148 | A | 1/1986 | Wentworth |
| 4,566,606 | A | 1/1986 | Kling |
| 4,570,820 | A | 2/1986 | Murphy |
| 4,601,938 | A | 7/1986 | Deacon et al. |
| 4,607,809 | A | 8/1986 | Sineni et al. |
| 4,648,530 | A | 3/1987 | Granger |
| 4,659,028 | A | 4/1987 | Wren |
| 4,662,576 | A | 5/1987 | Paul |
| 4,662,577 | A | 5/1987 | Lewis |
| 4,667,890 | A | 5/1987 | Gietman, Jr. |
| 4,684,075 | A | 8/1987 | Francis |
| 4,687,153 | A | 8/1987 | McNeil |
| 4,690,345 | A | 9/1987 | Cotey |
| 4,721,264 | A | 1/1988 | Muscarello |
| 4,735,317 | A | 4/1988 | Sussman et al. |
| 4,756,485 | A | 7/1988 | Bastian et al. |
| 4,775,109 | A | 10/1988 | Tegg |
| 4,775,119 | A | 10/1988 | Aronne |
| 4,784,290 | A | 11/1988 | Howard |
| 4,790,490 | A | 12/1988 | Chakravorty |
| 4,807,823 | A | 2/1989 | Wyant |
| 4,826,063 | A | 5/1989 | Ban |
| 4,828,193 | A | 5/1989 | Galbraith |
| 4,830,301 | A | 5/1989 | Miller |
| 4,834,316 | A | 5/1989 | DeLorean |
| 4,836,368 | A | 6/1989 | Cotton |
| 4,836,462 | A | 6/1989 | Bruss |
| 4,846,412 | A | 7/1989 | Morand |
| 4,860,893 | A | 8/1989 | Kaufman |
| D303,890 | S | 10/1989 | Pilot |
| 4,877,133 | A | 10/1989 | Klenter et al. |
| 4,883,197 | A | 11/1989 | Sanchez et al. |
| 4,884,690 | A | 12/1989 | Klenter et al. |
| 4,889,292 | A | 12/1989 | Lowe et al. |
| 4,890,205 | A | 12/1989 | Shaffer |
| 4,913,365 | A | 4/1990 | Shamass |
| 4,913,368 | A | 4/1990 | Atkinson |
| 4,936,452 | A | 6/1990 | Pauley |
| 4,940,626 | A | 7/1990 | Rhodes, III et al. |
| D311,106 | S | 10/1990 | Jaber |
| 4,978,095 | A | 12/1990 | Phillips |
| 4,984,530 | A | 1/1991 | Dutton |
| 4,989,800 | A | 2/1991 | Tritch |

4,991,538 A 2/1991 Davids et al.
5,000,393 A 3/1991 Madsen
5,001,956 A 3/1991 Nitsch
5,009,313 A 4/1991 Morand
5,012,986 A 5/1991 Needle
5,029,787 A 7/1991 Florentin
5,049,440 A 9/1991 Bornhoeft, III et al.
5,050,737 A 9/1991 Joslyn et al.
5,070,171 A 12/1991 O'Lenick, Jr.
5,104,054 A 4/1992 Latham
5,114,771 A 5/1992 Ogg et al.
5,137,173 A 8/1992 Hughes et al.
5,141,171 A 8/1992 Yang
5,145,091 A 9/1992 Meyers
5,149,765 A 9/1992 O'Lenick, Jr.
D329,978 S 10/1992 Ryan
5,154,496 A 10/1992 Campbell et al.
5,170,958 A 12/1992 Brown
5,172,840 A 12/1992 Bloch et al.
5,192,044 A 3/1993 Baskin
5,193,759 A 3/1993 Bigelow et al.
5,195,689 A 3/1993 Beer et al.
5,207,367 A 5/1993 Dunn et al.
5,219,092 A 6/1993 Morand
5,228,632 A 7/1993 Addison et al.
5,236,017 A 8/1993 Meyer et al.
5,237,035 A 8/1993 O'Lenick, Jr. et al.
5,253,818 A 10/1993 Craddock
5,255,800 A 10/1993 Kelly
5,260,401 A 11/1993 O'Lenick, Jr.
D342,635 S 12/1993 Carter et al.
D342,852 S 1/1994 Welch
5,277,375 A 1/1994 Dearwester
5,310,262 A 5/1994 Robison et al.
5,311,986 A 5/1994 Putz
5,312,883 A 5/1994 Komatsu et al.
5,317,063 A 5/1994 Komatsu et al.
D347,534 S 6/1994 Gottselig
5,335,811 A 8/1994 Morand
5,368,157 A 11/1994 Gasparrini et al.
5,370,336 A 12/1994 Whittington
5,374,008 A 12/1994 Halvorson et al.
5,384,189 A 1/1995 Kuroda et al.
5,392,945 A 2/1995 Syrek
D356,707 S 3/1995 Morand
5,400,982 A 3/1995 Collins
5,409,181 A 4/1995 Patrick
5,411,729 A 5/1995 O'Lenick, Jr.
5,439,521 A 8/1995 Rao
5,443,084 A 8/1995 Saleur
5,449,127 A 9/1995 Davis
D362,773 S 10/1995 Kartchner
5,456,420 A 10/1995 Frazier
5,456,421 A 10/1995 Reed
5,462,197 A 10/1995 Pound
5,464,096 A 11/1995 Hurwitz
5,464,170 A 11/1995 Mitchell et al.
5,480,060 A 1/1996 Blythe
5,494,250 A 2/1996 Chen
5,495,997 A 3/1996 Moody
5,501,323 A 3/1996 Denesha et al.
5,509,593 A * 4/1996 Bloch et al. ..... 225/37
5,520,308 A 5/1996 Berg, Jr. et al.
5,526,973 A 6/1996 Boone et al.
5,533,621 A 7/1996 Schoal, Jr.
5,540,332 A 7/1996 Kopacz et al.
5,542,568 A 8/1996 Julius
5,560,514 A * 10/1996 Frazier ..... 221/63
5,562,964 A 10/1996 Jones
5,588,615 A 12/1996 Batts
D377,284 S 1/1997 Farrow et al.
5,598,987 A 2/1997 Wachowicz
5,604,992 A 2/1997 Robinson
5,605,250 A 2/1997 Meiron et al.
5,609,269 A 3/1997 Behnke et al.
5,618,008 A 4/1997 Dearwester et al.
5,620,148 A 4/1997 Mitchell
5,624,025 A 4/1997 Hixon
5,630,526 A 5/1997 Moody
5,630,563 A 5/1997 Meisner et al.
5,631,317 A 5/1997 Komatsu et al.
5,642,810 A 7/1997 Warner et al.
5,649,676 A 7/1997 Lord
D381,851 S 8/1997 Sharpe
5,653,403 A 8/1997 Ritchey
5,655,661 A 8/1997 Rigby
5,660,313 A * 8/1997 Newbold ..... 225/42
5,660,636 A 8/1997 Shangold et al.
5,667,092 A 9/1997 Julius et al.
5,669,576 A 9/1997 Moody
5,672,206 A 9/1997 Gorman
D386,025 S 11/1997 Mervar et al.
5,687,875 A 11/1997 Watts et al.
D387,590 S 12/1997 Cameron et al.
5,697,576 A 12/1997 Bloch et al.
5,697,577 A 12/1997 Ogden
5,704,565 A 1/1998 Cheng
5,704,566 A 1/1998 Schutz et al.
5,727,458 A 3/1998 Schultz
5,755,654 A 5/1998 Schultz et al.
5,763,332 A 6/1998 Gordon et al.
5,765,717 A 6/1998 Gottselig
D397,265 S 8/1998 Badillo
5,839,688 A 11/1998 Hertel et al.
RE35,976 E 12/1998 Gasparrini et al.
5,848,762 A 12/1998 Reinheimer et al.
5,868,275 A 2/1999 Moody
5,868,335 A 2/1999 Lebrun
5,868,344 A 2/1999 Melnick
5,868,345 A 2/1999 Beisser
5,868,346 A 2/1999 Cobos
5,868,347 A 2/1999 Paul et al.
5,875,985 A 3/1999 Cohen et al.
5,887,759 A 3/1999 Ayigbe
5,887,818 A 3/1999 Kelley
5,893,531 A 4/1999 Taylor et al.
5,897,074 A * 4/1999 Marino ..... 242/594.1
5,901,921 A 5/1999 Perlsweig
5,904,316 A 5/1999 Dunning et al.
5,914,177 A 6/1999 Smith, III et al.
5,924,617 A 7/1999 LaCount et al.
D412,439 S 8/1999 Cormack
5,938,013 A 8/1999 Palumbo et al.
5,950,960 A 9/1999 Marino
5,951,762 A 9/1999 Shangold et al.
5,958,187 A 9/1999 Bhat et al.
5,964,351 A 10/1999 Zander
5,967,452 A 10/1999 Wilder
5,971,138 A 10/1999 Soughan
5,971,142 A 10/1999 Jones
D416,794 S 11/1999 Cormack
D417,109 S 11/1999 Johnson et al.
5,979,821 A 11/1999 LaCount et al.
5,992,718 A 11/1999 Zaranek
D417,987 S 12/1999 Velazquez
6,000,538 A 12/1999 Lee
6,000,658 A 12/1999 McCall, Jr.
6,007,019 A 12/1999 Lynch
6,010,001 A 1/2000 Osborn, III
6,015,125 A 1/2000 Fischer
6,024,216 A 2/2000 Shillington et al.
6,024,217 A 2/2000 Ponsi et al.
6,024,323 A 2/2000 Palerno, Jr.
6,029,921 A 2/2000 Johnson
D421,690 S 3/2000 Sutherland
D421,691 S 3/2000 Hoblitz

| | | | | |
|---|---|---|---|---|
| 6,036,134 | A | 3/2000 | Moody | |
| D422,437 | S | 4/2000 | Conran et al. | |
| 6,047,920 | A | 4/2000 | Dearwester et al. | |
| 6,056,233 | A | 5/2000 | Von Schenk | |
| 6,056,235 | A | 5/2000 | Brozinsky | |
| 6,059,882 | A | 5/2000 | Steinhardt et al. | |
| 6,059,928 | A | 5/2000 | Van Luu et al. | |
| 6,068,118 | A | 5/2000 | Calloway | |
| 6,070,821 | A | 6/2000 | Mitchell | |
| 6,079,603 | A | 6/2000 | Smegal | |
| 6,082,664 | A | 7/2000 | Phelps et al. | |
| 6,085,899 | A | 7/2000 | Thorsbakken | |
| 6,092,690 | A | 7/2000 | Bitowft et al. | |
| 6,092,758 | A | 7/2000 | Gemmell | |
| 6,092,759 | A | 7/2000 | Gemmell et al. | |
| D429,282 | S | 8/2000 | Valazquez et al. | |
| 6,098,836 | A | 8/2000 | Gottselig | |
| 6,121,165 | A | 9/2000 | Mackey et al. | |
| 6,138,939 | A | 10/2000 | Phelps et al. | |
| 6,158,614 | A * | 12/2000 | Haines et al. | 221/63 |
| D441,231 | S | 5/2001 | Purcell et al. | |
| 6,228,454 | B1 | 5/2001 | Johnson et al. | |
| 6,237,871 | B1 | 5/2001 | Morand et al. | |
| 6,257,410 | B1 | 7/2001 | Ulmann et al. | |
| D451,728 | S | 12/2001 | Phelps et al. | |
| D457,765 | S | 5/2002 | Peotter et al. | |
| D457,766 | S | 5/2002 | Omdoll et al. | |
| 6,382,552 | B1 | 5/2002 | Paul et al. | |
| 6,412,726 | B2 | 7/2002 | Inana et al. | |
| 6,423,804 | B1 | 7/2002 | Chang et al. | |
| 6,429,261 | B1 | 8/2002 | Lang et al. | |
| D462,215 | S | 9/2002 | Bartelt et al. | |
| 6,444,214 | B1 | 9/2002 | Cole et al. | |
| 6,451,748 | B1 | 9/2002 | Taylor et al. | |
| 6,523,690 | B1 * | 2/2003 | Buck et al. | 206/494 |
| 6,537,631 | B1 * | 3/2003 | Rivera et al. | 428/36.91 |
| 6,585,131 | B2 * | 7/2003 | Huang et al. | 221/48 |
| 6,592,004 | B2 * | 7/2003 | Huang et al. | 221/63 |
| 6,623,834 | B1 | 9/2003 | Nissing et al. | |
| 6,649,262 | B2 | 11/2003 | Hoo et al. | |
| 2001/0039786 | A1 | 11/2001 | Romme et al. | |
| 2002/0005452 | A1 | 1/2002 | Rome et al. | |
| 2002/0036208 | A1 | 3/2002 | Faulks et al. | |
| 2002/0043537 | A1 * | 4/2002 | Serbiak | 221/33 |
| 2002/0056785 | A1 | 5/2002 | Newman et al. | |
| 2003/0019974 | A1 | 1/2003 | Faulks et al. | |
| 2004/0124101 | A1 * | 7/2004 | Mitchell et al. | 206/205 |
| 2005/0136775 | A1 * | 6/2005 | Tanaka | 442/403 |

FOREIGN PATENT DOCUMENTS

| | | | |
|---|---|---|---|
| EP | 0 122 809 | A1 | 10/1984 |
| EP | 0 251 103 | A1 | 1/1988 |
| EP | 0287545 | | 10/1988 |
| EP | 0343304 | | 11/1989 |
| EP | 0 501 905 | A1 | 9/1992 |
| EP | 0 608 460 | A1 | 8/1994 |
| EP | 0728426 | | 8/1996 |
| EP | 0 608 460 | B1 | 9/1998 |
| EP | 1002746 | | 5/2000 |
| EP | 1 023 863 | A1 | 8/2000 |
| EP | 1 048 257 | A2 | 11/2000 |
| EP | 1 048 257 | A3 | 11/2000 |
| GB | 990332 | | 4/1965 |
| GB | 1324818 | | 7/1973 |
| GB | 1 327 954 | | 8/1973 |
| GB | 1048257 | | 11/2000 |
| GB | 2 357 076 | A | 6/2001 |
| JP | 57170658 | | 10/1982 |
| WO | WO 93/17933 | | 9/1993 |
| WO | WO 96/21388 | A1 | 7/1996 |
| WO | WO 97/24054 | | 7/1997 |
| WO | WO 98/08763 | A1 | 3/1998 |
| WO | WO 98/34781 | | 8/1998 |
| WO | WO 99/06311 | A2 | 2/1999 |
| WO | WO 99/01536 | A1 | 4/1999 |
| WO | WO 00/00071 | | 1/2000 |
| WO | WO 00/08998 | | 2/2000 |
| WO | WO 00/57843 | | 10/2000 |
| WO | WO 00/65973 | | 11/2000 |
| WO | WO 00/65974 | | 11/2000 |
| WO | WO 00/65975 | | 11/2000 |
| WO | WO 01/17496 | | 3/2001 |
| WO | WO 01/41613 | | 6/2001 |
| WO | WO 01/82763 | | 11/2001 |

OTHER PUBLICATIONS

Derwent World Patent Database abstract of JP 07-284,461 A: Description of Kusunoki N (KUSU-I), "Toilet Paper Holder," and Patent Abstracts of Japan JP 07-284,461: Description of Kusunoki Nobuaki, "Toilet Paper-Holder Allowing Taking Out Paper Thereof With One Hand."

Derwent World Patent Database abstract of JP 00-085,782 A: Description of Pigeon KK (PIGE-N), "Paper Holder For Wet Tissues Used In Toilets," and Patent Abstracts of Japan JP 00-085,782: Description of Watanabe Kuniko et al., "Paper Holder."

Kotler, Philip, *Marketing Management*, Prentice Hall, Upper Saddle River, NJ, 2000, p. 456-483.

PCT search report for application serial No.: PCT/US00/11284, dated Jul. 28, 2000.

Images of Moist Mates product—dispenser and wipes, approximately 1996.

Images of Moist Mates product—dispenser, approximately 2000.

Images of Moist Mates product—refill wipes, approximately 2000.

Images of Fresh & Clean product—wet toilet paper, approximately Sep. 2000; 3 pages pl attached translation.

Examination Report for European Patent Office Application No. 01 933 400.2, dated Feb. 22, 2005, 4 pages.

Written Opinion in International Application No. PCT/US01/40677, dated Oct. 30, 2003, 5 pages.

Invitation to Pay Additional Fees for Patent Cooperation Treaty application No. PCT/US 01/27698, Date of Mailing Jan. 10, 2002, 7 pages.

Search Report for Patent Cooperation Treaty application No. PCT/US 01/28520, Date of Mailing Mar. 4, 2002, 7 pages.

Search Report for Patent Cooperation Treaty application No. PCT/US01/27698, Date of Mailing Apr. 5, 2002, 4 pages.

Search Report for Patent Cooperation Treaty Appl. No. PCT/US 01/11195, Date of Mailing Jul. 19, 2001, 7 pages.

Search Report for Patent Cooperation Treaty Appl. No. PCT/US 01/11198, Date of Mailing Jul. 19, 2001, 7 pages.

Search Report for Patent Cooperation Treaty Appl. No. PCT/US 01/11620, Date of Mailing Jul. 19, 2001, 7 pages.

Search Report for Patent Cooperation Treaty Appl. No. PCT/US 01/11686, Date of Mailing Jul. 11, 2001, 5 pages.

Search Report for Patent Cooperation Treaty Appl. No. PCT/US 01/11131, Date of Mailing Jul. 23, 2001, 7 pages.

Search Report for Patent Cooperation Treaty Appl. No. PCT/US 01/11447, Date of Mailing Jul. 19, 2001, 6 pages.

Search Report for Patent Cooperation Treaty Appl. No. PCT/US 01/11467, Date of Mailing Jul. 19, 2001, 7 pages.

Search Report for Patent Cooperation Treaty Appl. No. PCT/US 01/12091, Date of Mailing Jul. 9, 2001, 4 pages.

Search Report for Patent Cooperation Treaty Appl. No. PCT/US 01/14113, Date of Mailing Jul. 19, 2001, 6 pages.

Search Report for Patent Cooperation Treaty Appl. No. PCT/US 01/40677, Date of Mailing Jul. 19, 2001, 6 pages.

Letter, dated Apr. 4, 1998, and accompanying drawings.

* cited by examiner

Fig. 11
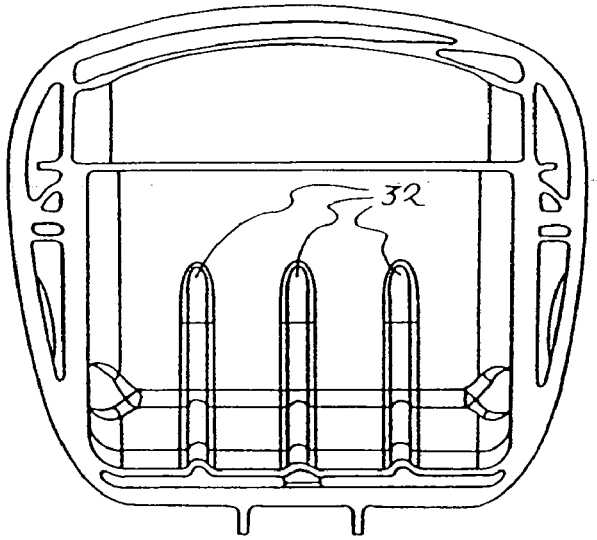
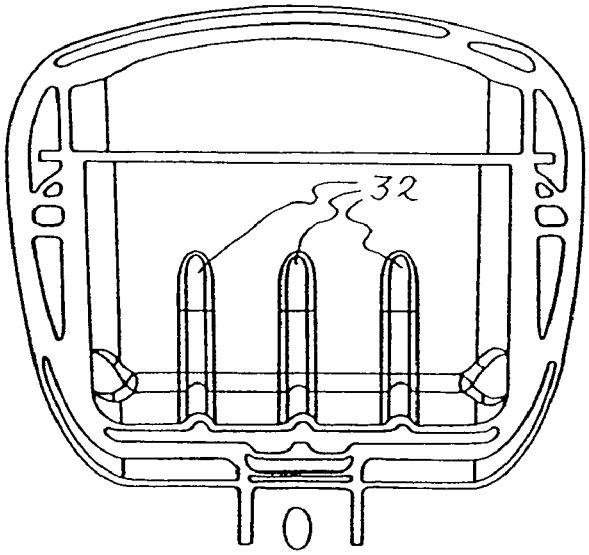
Fig. 12

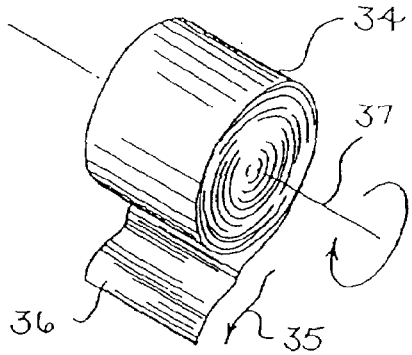
Fig. 18
Fig. 19
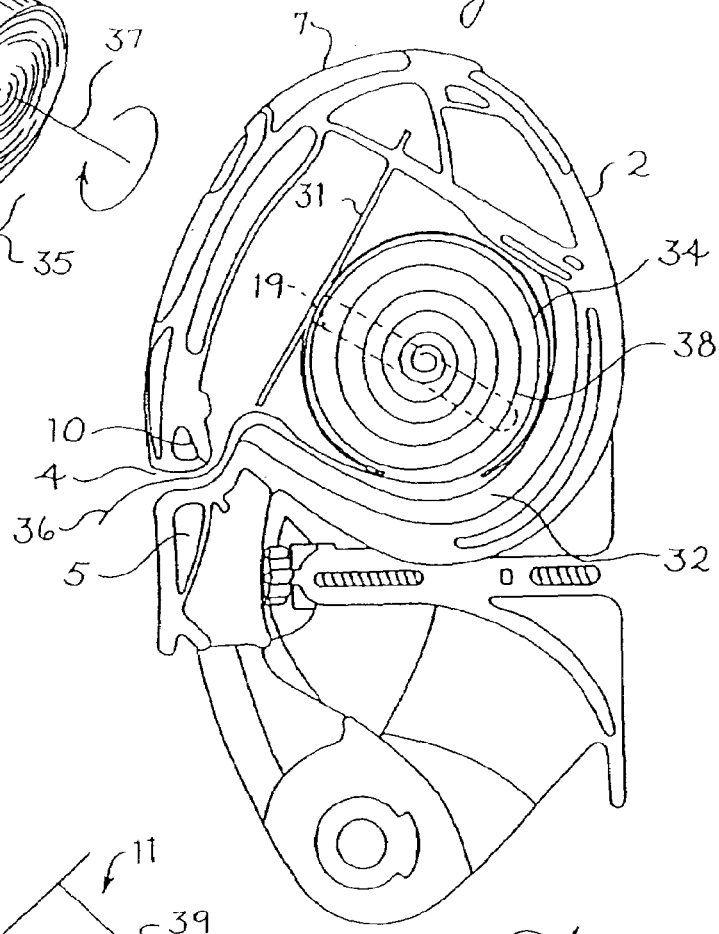
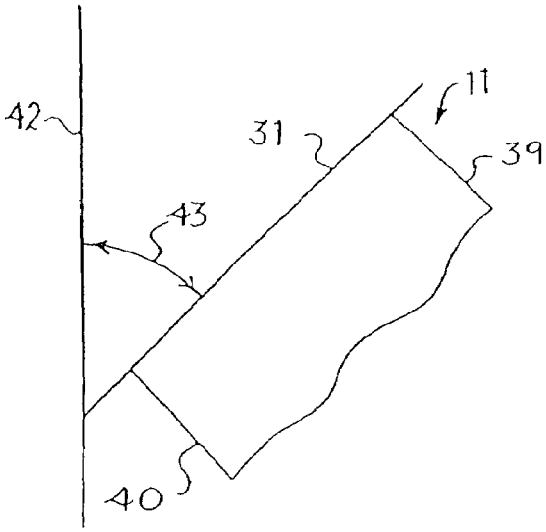
Fig. 20
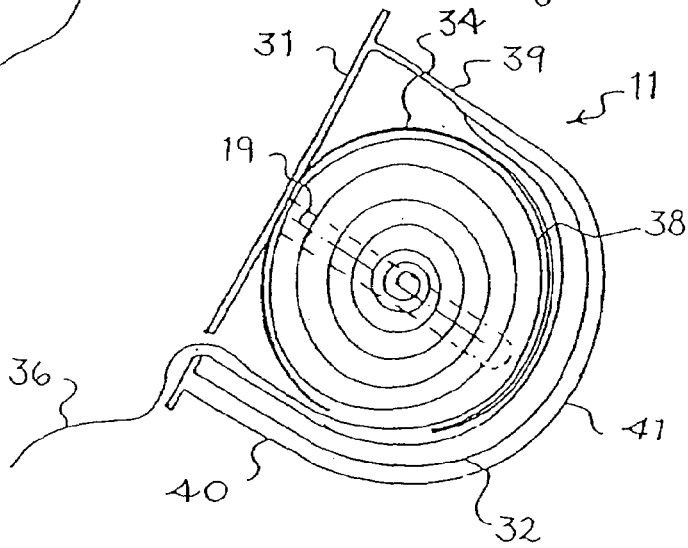
Fig. 21

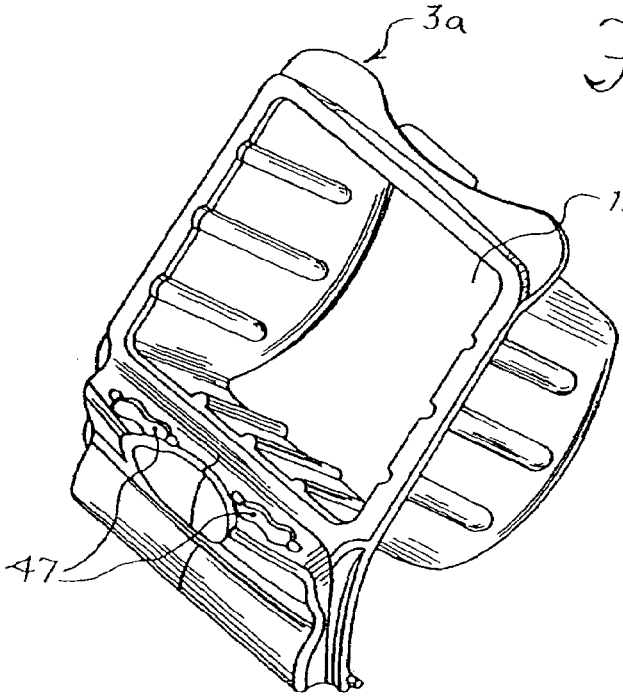
Fig. 26
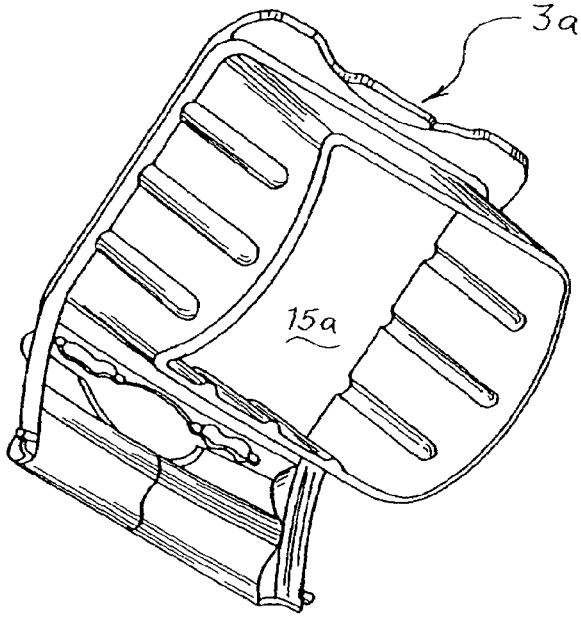
Fig. 27
Fig. 28
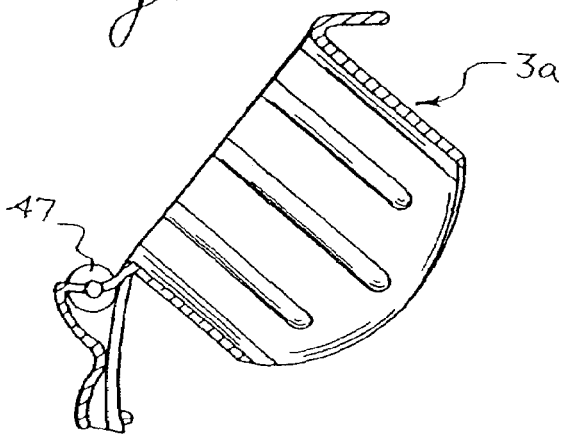

Fig. 47
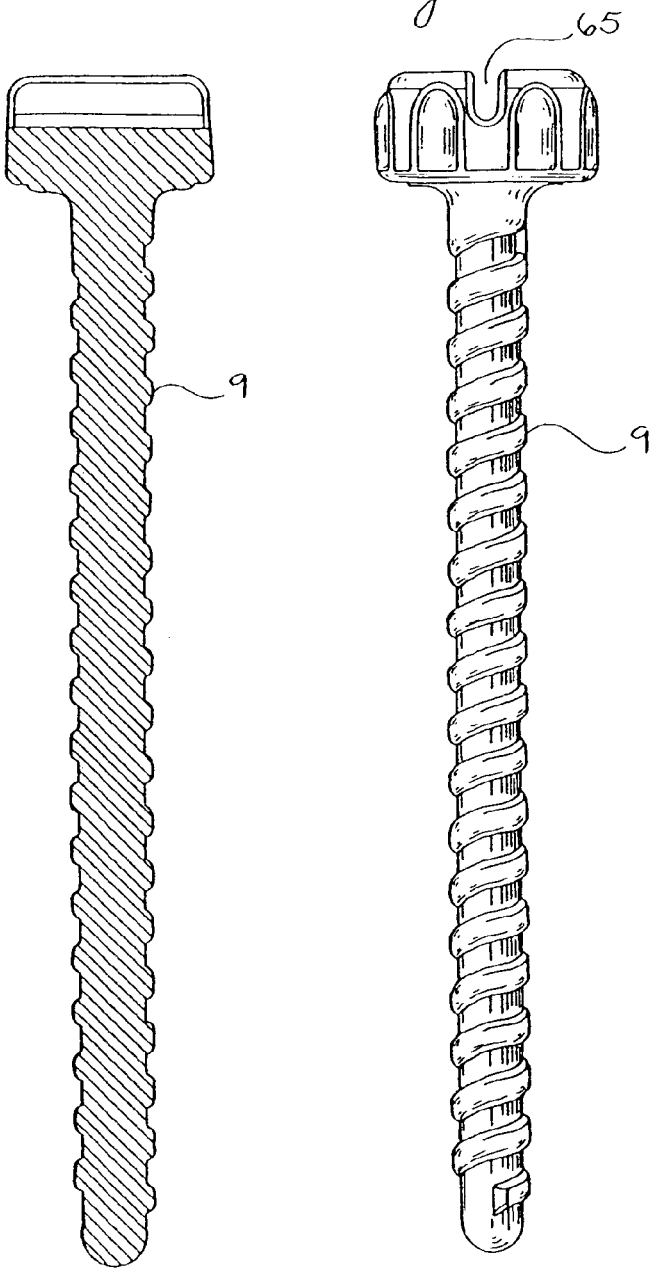
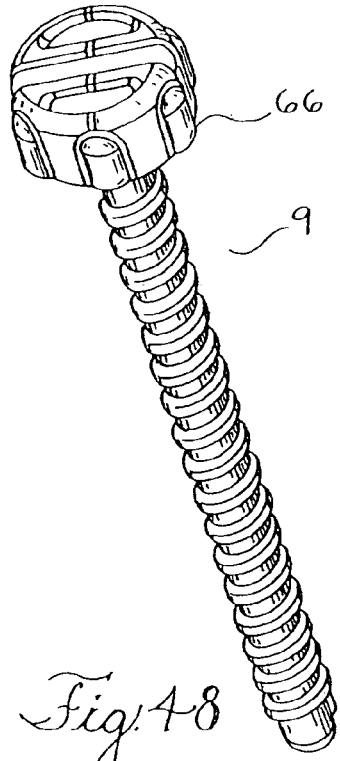
Fig. 48
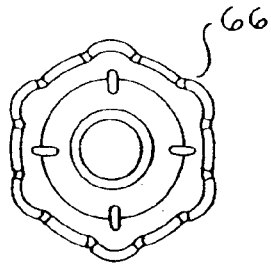
Fig. 49
Fig. 46
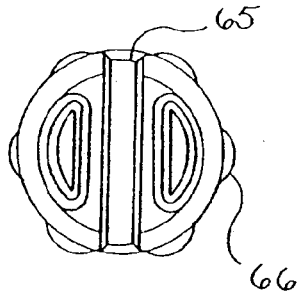
Fig. 50

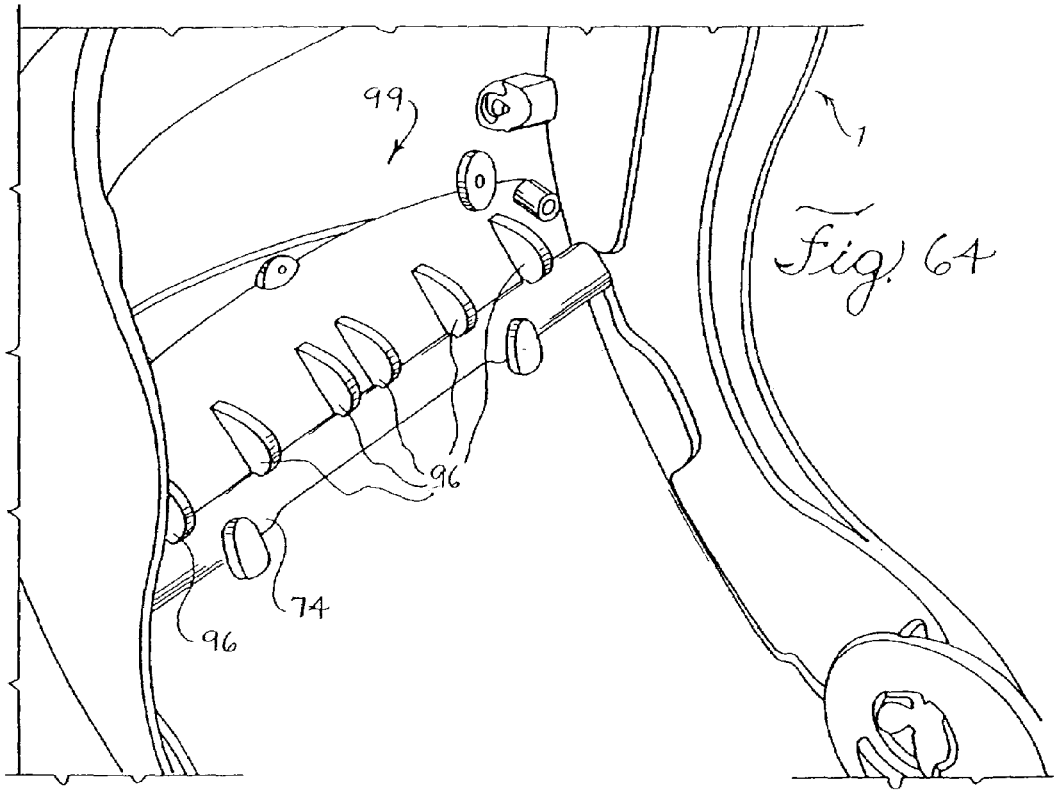
Fig. 64
Fig. 65
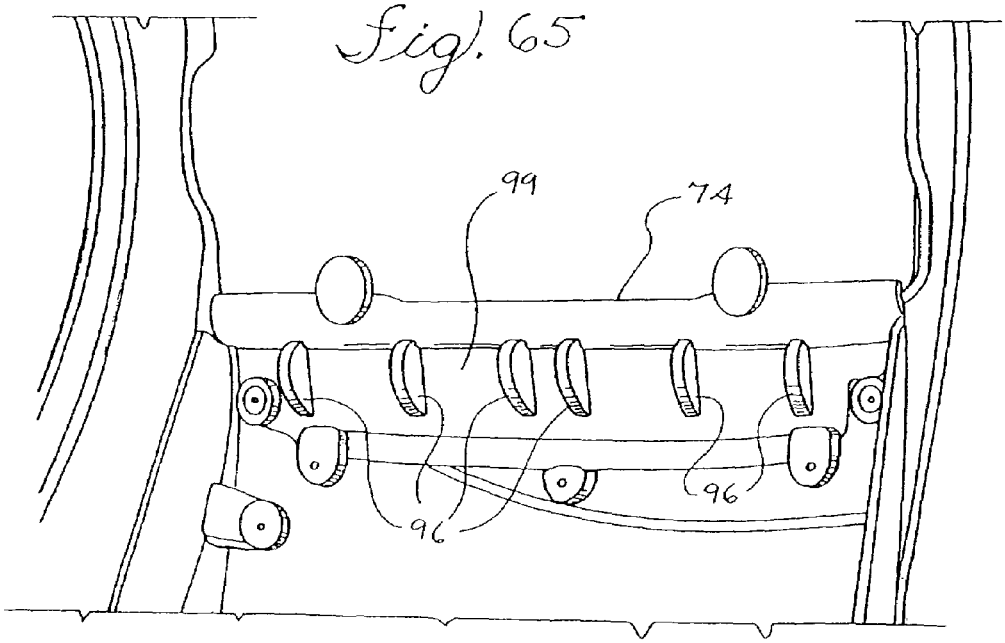

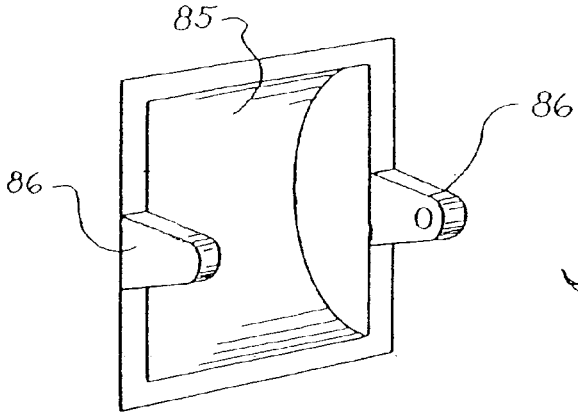
Conventional
Fig. 66
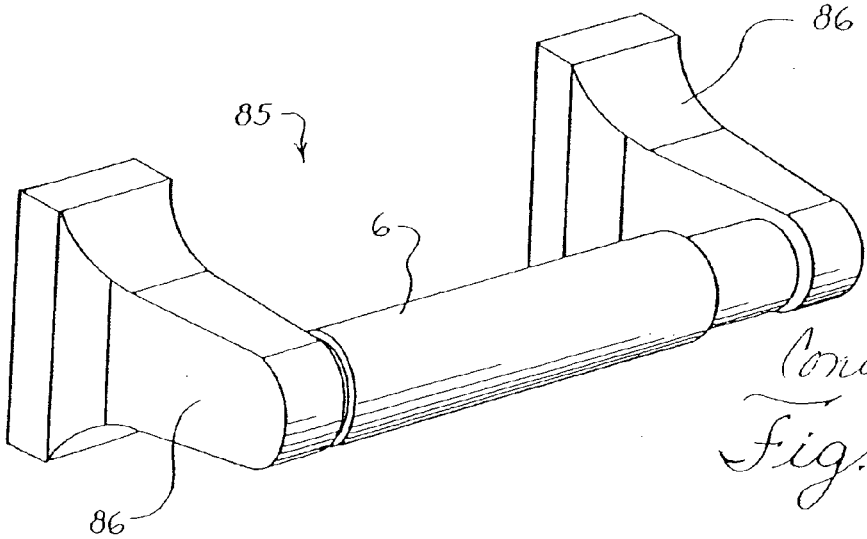
Conventional
Fig. 67

DISPENSING SYSTEM FOR WIPES

This application is a continuation in part of U.S. patent application Ser. No. 09/565,227, filed May 4, 2000, now U.S. Pat. No. 6,705,565, which is a continuation in part of U.S. patent application Ser. No. 09/545,995, filed Apr. 10, 2000, now U.S. Pat. No. 6,626,395 and which claims the benefit of the filing date pursuant to 35 U.S.C. § 119(e) of, U.S. Provisional Application Ser. No. 60/132,024, filed Apr. 30, 1999, the disclosure of which is hereby incorporated by reference.

FIELD OF THE INVENTION

This invention relates to dispensers and, more specifically, to a dispenser for more than one product, such as wipes or dry bathroom tissue.

BACKGROUND OF THE INVENTION

Dispensers for wipes or tissues can take many forms. Stacks of sheets can be contained in a disposable box or plastic wrapper having an opening in the top. Alternatively, stacks of sheets can be contained in a permanent, box-like dispenser. This method frequently dispenses the wipe or tissue from the bottom of the dispenser. Paper towels and dry bathroom tissue can be stored in roll form and dispensed by rotating the roll around a spindle. This rotational dispensing system can also be controlled in a metered fashion by use of an enclosed dispenser and a lever.

For example, wet wipes have been traditionally dispensed in sheet form from a tub like container with a hinged lid on the top. The lid is opened and individual or singularized sheets of the wipes are removed. Another type of container that has been used for wet wipes provides a roll of wipes in which the wipes are pulled from the top of the container in a direction that is parallel to the axis of the roll. These wipes are pulled from the center of a hollow coreless roll that has perforated sheets. These containers generally have a snap top lid that is opened to expose a piece of the wipes that can then be pulled to remove the desired amount of wipes. Once pulled out the wipes can then be torn off, usually at a perforation, and the lid closed. Embodiments of dispensers are described in U.S. patent application Ser. No. 09/659,307, now U.S. Pat. No. 6,827,309, and in U.S. patent application Ser. No. 09/659,295, now U.S. Pat. No. 6,702,227, the disclosures of which are incorporated herein by reference.

SUMMARY OF THE INVENTION

In an embodiment of the invention there is provided a dispensing system for wipes comprising: a dispenser; a wiper blade; wipes, the wipes comprising a contained agent; and a gap in the dispenser; wherein the wipes are capable of being positioned through the gap, the wiper blade exerting pressure on the wipes sufficient to moisten the sheet.

In an embodiment of the invention there is provided a method of dispensing wipes from a dispenser comprising: pulling wipes from a dispenser, the wipes comprising a contained agent; wherein the pulling results in the dispenser exerting a force on the wipes such that the contained agent is released.

In an embodiment of the invention there is provided a dispensing system for wipes comprising: a dispenser; a gap; a wiper blade associated with the gap; and wipes, the wipes comprising two portions; the first portion of the wipes being inside the dispenser; the second portion of the wipes being outside the dispenser; the first portion comprising a contained agent; the second portion comprising a contained agent which is released.

These embodiments may further comprise wipes which have a dry feel; wipes wherein the agent is contained in an emulsion, in microcapsules; and/or in a membrane; and/or a mounting assembly in the dispenser, wherein the dispenser may be secured to a conventional dry bath tissue dispenser and at least one surface by means of the mounting assembly.

DRAWINGS

FIG. 1 is a perspective view of a dispenser.
FIG. 2 is an exploded view of a dispenser and cartridge.
FIG. 2*a* is a plan view of a portion of the front of the tray.
FIG. 3 is a perspective view of an open dispenser.
FIG. 4 is a top view of a dispenser.
FIG. 5 is a front view of a dispenser.
FIG. 6 is a bottom view of a dispenser.
FIG. 7 is a side view of a dispenser.
FIG. 8 is a back view of a dispenser.
FIG. 9 is a cross section view of a dispenser and cartridge taken along line A—A of FIG. 5.
FIG. 10 is a cross section view along line D—D of FIG. 9.
FIG. 11 is a cross section view along line E—E of FIG. 9.
FIG. 12 is a cross section view along line F—F of FIG. 9.
FIG. 13 is a cross section view of a dispenser and cartridge taken along line C—C of FIG. 5.
FIG. 14 is a cross section view along line J—J of FIG. 13.
FIG. 15 is a cross section view along line K—K of FIG. 13.
FIG. 16 is a perspective view of a dispenser with a wet wipe.
FIG. 17 is a perspective view of a dispenser, a cartridge and a roll of wet wipes.
FIG. 18 is a perspective view of a roll of wet wipes FIG. 19 is a cross section view of a dispenser, a cartridge and a roll of wet wipes.
FIG. 20 is a cross section view of a cartridge and a roll of premoistened wipes.
FIG. 21 is a cross section view of a cartridge.
FIG. 22 is a perspective view of the outside of a cover.
FIG. 23 is a front view of the outside of a cover.
FIG. 24 is a perspective view of the inside of a cover.
FIG. 25 is a cross section view of a cover.
FIGS. 26–28 are views of a tray.
FIGS. 29–31 are views of a roller.
FIGS. 32–37 are views of a wiper assembly.
FIG. 36 is a view along line A—A of FIG. 35.
FIG. 34 is a view along line A—A of FIG. 32.
FIGS. 38–39 are views of a wiper.
FIGS. 40–41 are views of a roller.
FIGS. 42–45 are views of a mounting assembly.
FIGS. 46–50 are views of a screw used in conjunction with the mounting assembly.
FIGS. 51–53 are views of a cartridge.
FIG. 54 is a top view of a package of cartridges.
FIG. 55 is a perspective view of a dispenser.
FIG. 56 is an exploded view of a dispenser and cartridge.
FIG. 57 is a front plan view of a wiper assembly.
FIG. 58 is a front plan view of a wiper assembly.
FIG. 59 is a plan view of a wiper blade.
FIG. 60 is a cross-sectional view of a wiper blade.
FIG. 61 is a perspective view of a wiper blade.
FIG. 62 is a cross-sectional view of a dispenser.

FIG. 64 is a perspective view of the inside of a cover.

FIG. 65 is a top view of the inside of a cover.

FIG. 66 is a view of a conventional bath tissue holder.

FIG. 67 is a view of a conventional bath holder.

DETAILED DESCRIPTION OF THE INVENTION

A system and method for dispensing and providing wipes is provided, which in general may have a housing, a cover, and a cartridge having a roll of wet wipes. The cartridge is placed in the housing and then the wipes can be removed from the dispenser.

Figure 68:
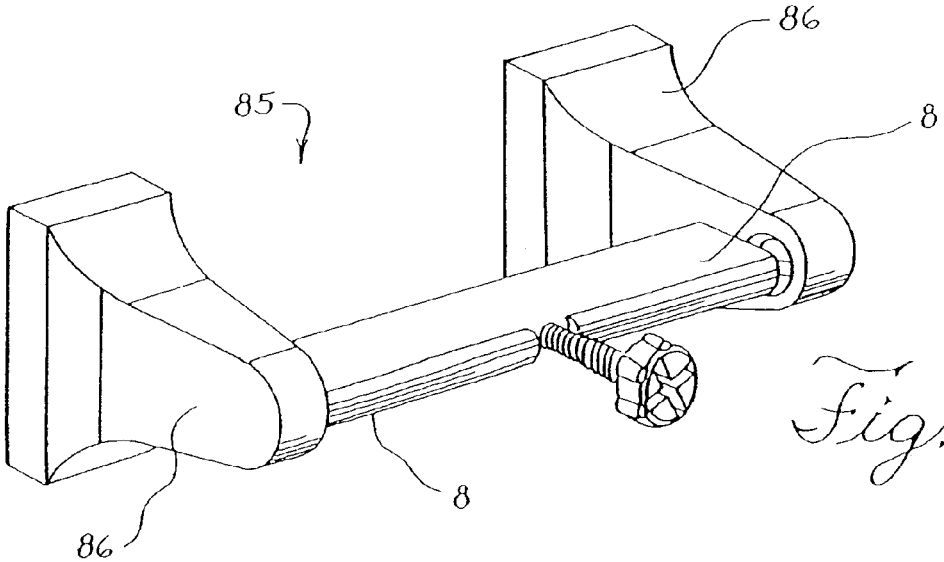
FIG. 68 is a view of a mounting assembly in a conventional bath tissue holder (shown without the dispenser).

In general there is provided a device for mounting a wet wipes dispenser to another surface. That surface may be, by way of example, a wall in a bathroom, a kitchen wall, or a bathroom vanity wall. The device may be used with, or adapted for use with, most any type of wet wipes dispenser, such as the various dispensers illustrated and disclosed herein. The device is ideally adapted to work in conjunction with a conventional bath tissue holder to permit a dispenser to be securely, yet removably attached to the wall. A conventional bath tissue holder is the type that is typically found in a home. Such holders have posts that protrude from the wall and a rod or roller that is positioned between the posts. These holders may also be partially recessed into the wall. Such a holder and a holder with a mounting assembly engaged are illustrated in FIGS. 66–68. The device may also be used in the absence of a conventional bath tissue holder and may be adapted to provide that the dispenser is fixed to the wall.

For example, the system may have a dispenser that has a housing, which is capable of being mounted to a surface, such as a wall, a cabinet, an existing bath tissue dispenser, a toilet, a toilet tank, a stall wall, or a dashboard of an automobile. The dispenser has an opening that holds a cartridge, which contains the wet wipes. These cartridges are sealed and may be grouped in packages of multiple cartridges. Thus, a package of cartridges may be provided to a user. The user may then select and open one of the cartridges, put it in the dispenser, and use the wipes as needed. When the wipes are used up, the user may simply discard the old cartridge and replace it with a new one. Thus, this system enables the user to conveniently obtain and keep several cartridges of wipes on hand and then use the wipes as needed. By using sealed cartridges to refill the dispenser the user is using a new and fresh product each time and a product that is in contact with fresh surfaces.

By way of example, referring to FIGS. 1 through 15, there is provided a dispenser 1, which has a housing 2, a tray 3, a cover 7, and a mounting assembly 8. The tray and the cover form a gap 4, through which a wet wipe can extend. That portion of the wipe extending through the gap may be referred to as a tail. The tray and cover additionally have recesses 5, that form an indentation that provides a finger hold, or point where a user can grasp the wet wipe to pull it from the dispenser. Although optional, this dispenser is also provided with a roller 6 for mounting and dispensing a roll of another product, such as dry or conventional bath tissue.

In general the dispenser system illustrated herein can be used with or without conventional dry toilet or bath tissue. If conventional tissue is used with wet wipes it could be positioned in a side-by-side manner, above, or below the wet wipes.

Figure 2:
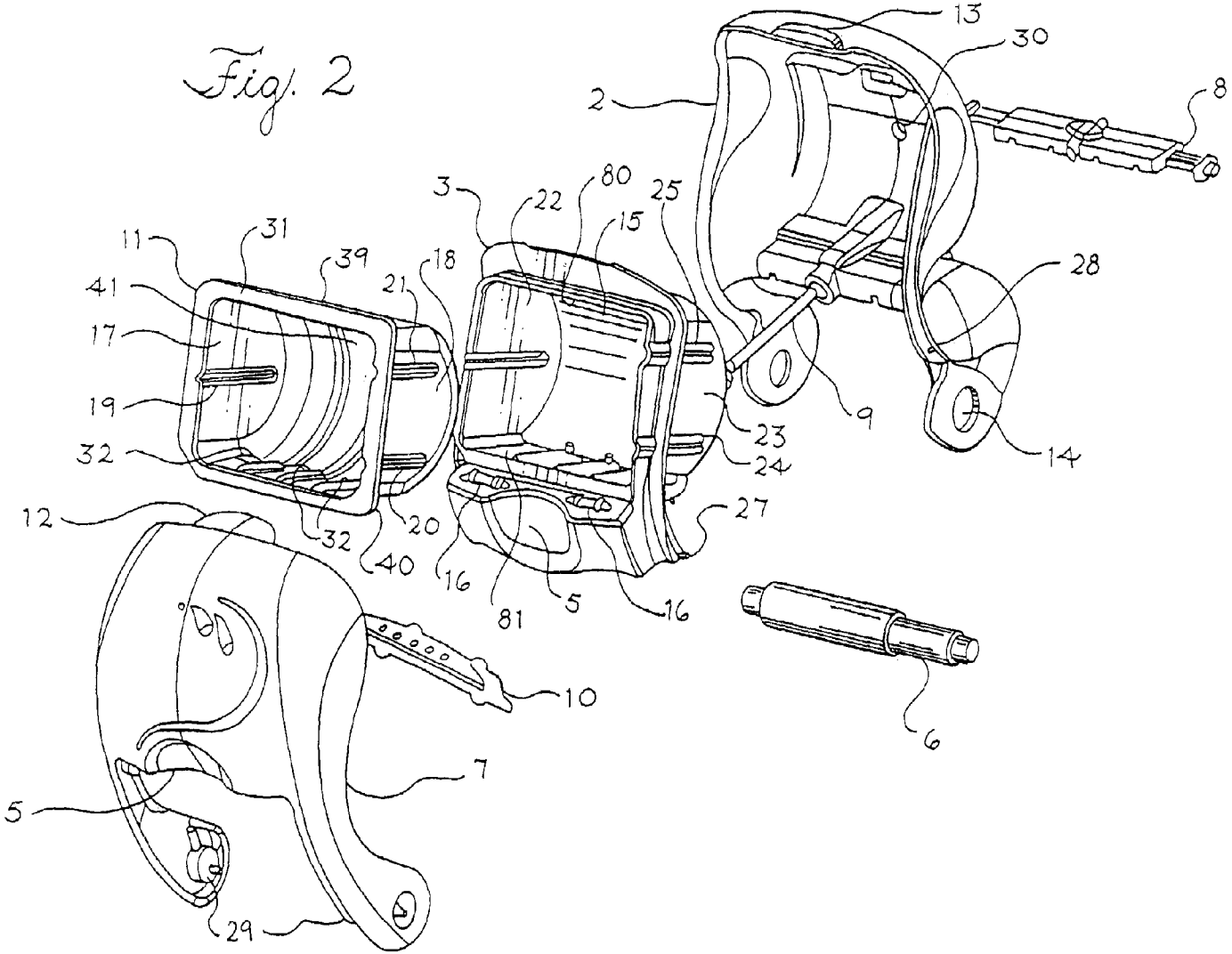
Figure 3:
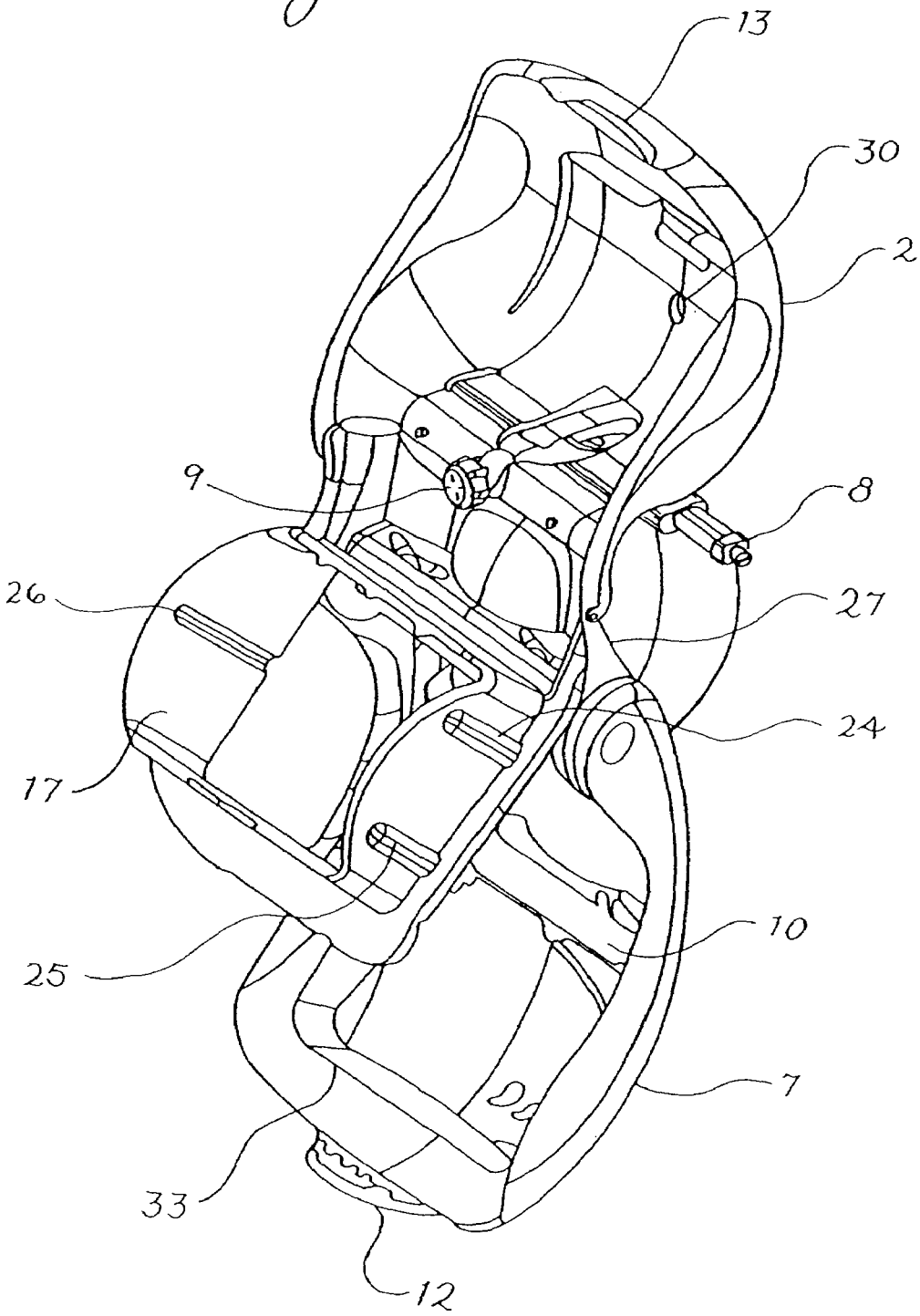
Figure 4:
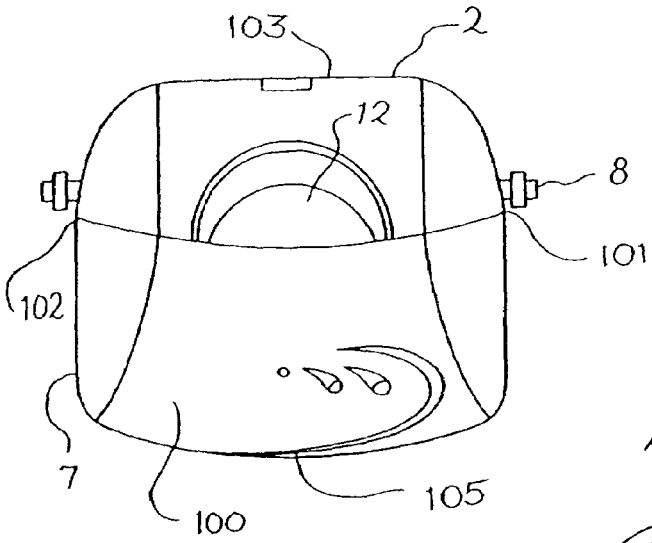
Figure 5:
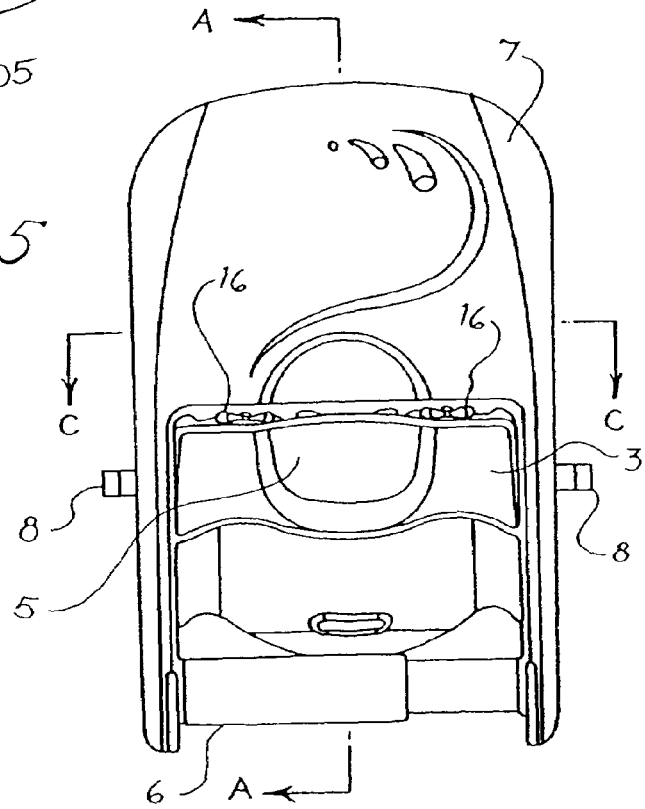
Figure 6:
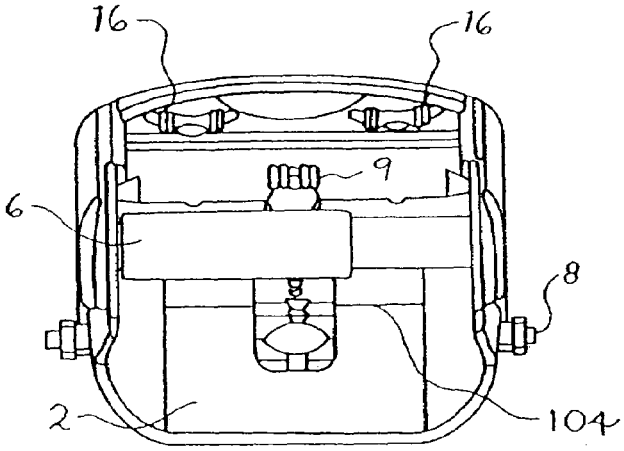
Figure 7:
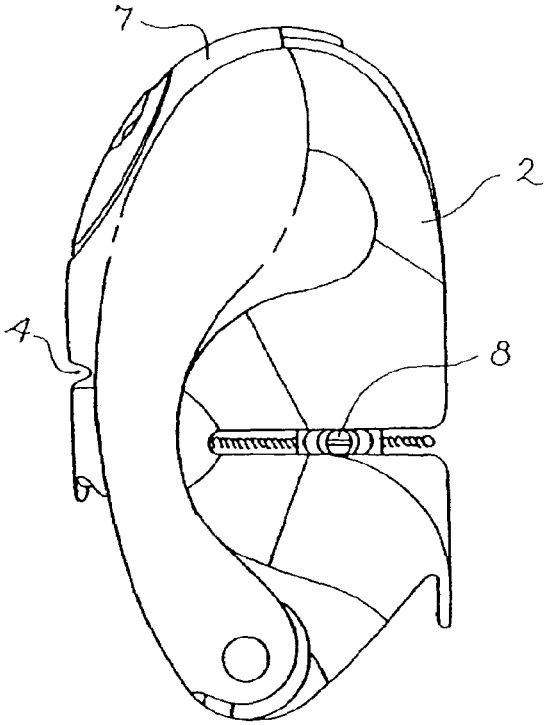
Figure 8:
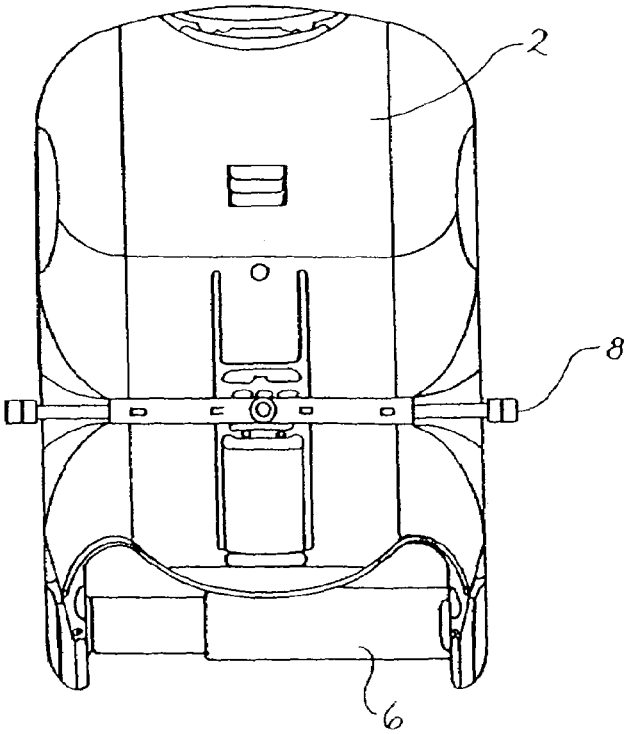
Figure 10:
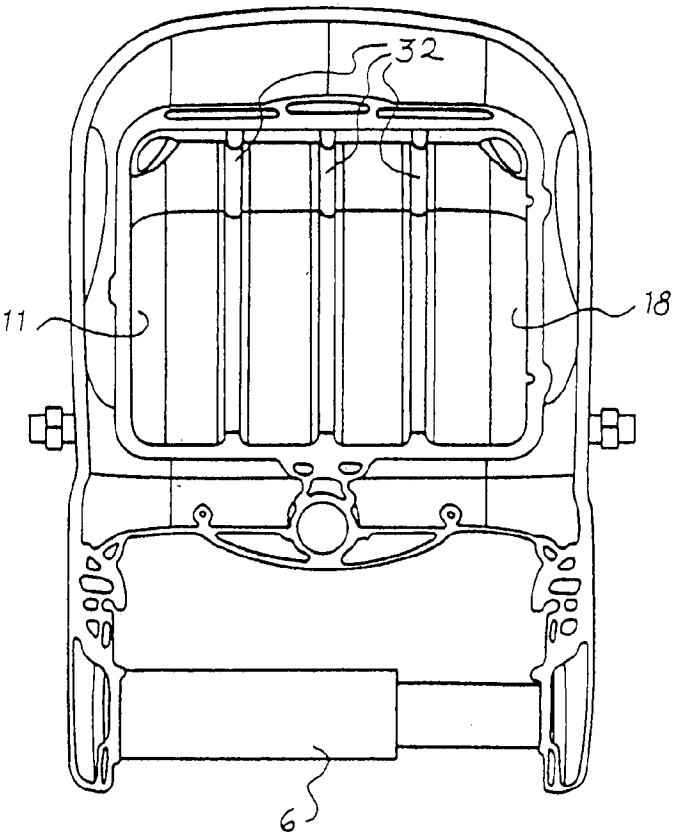
Figure 9:
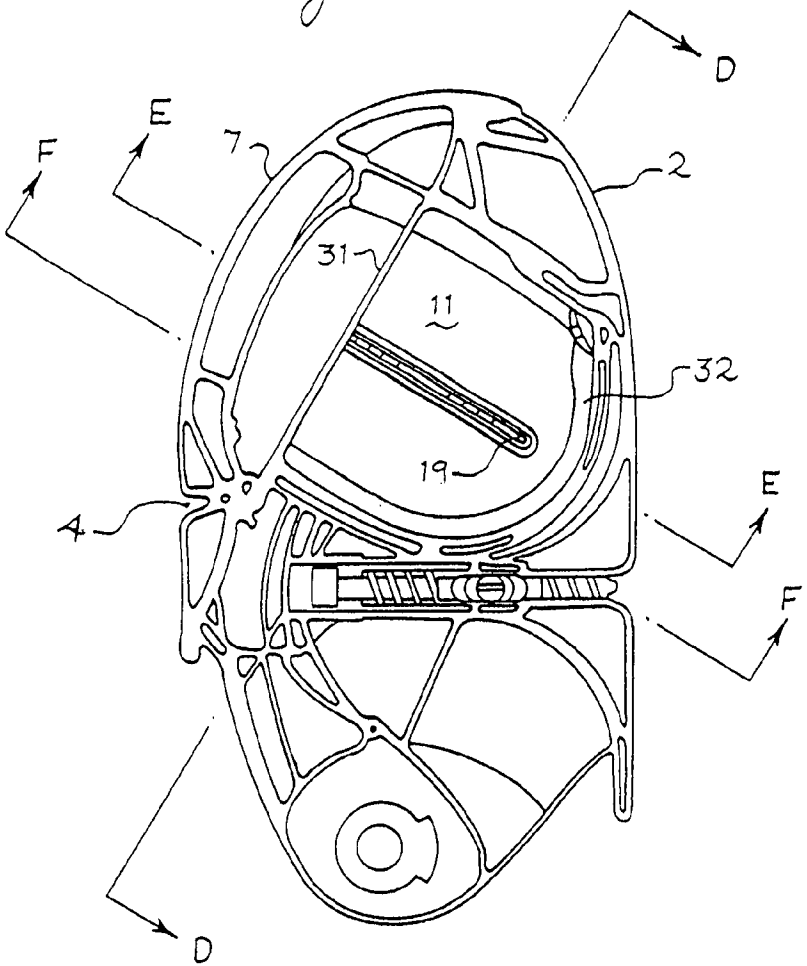
Figure 14:
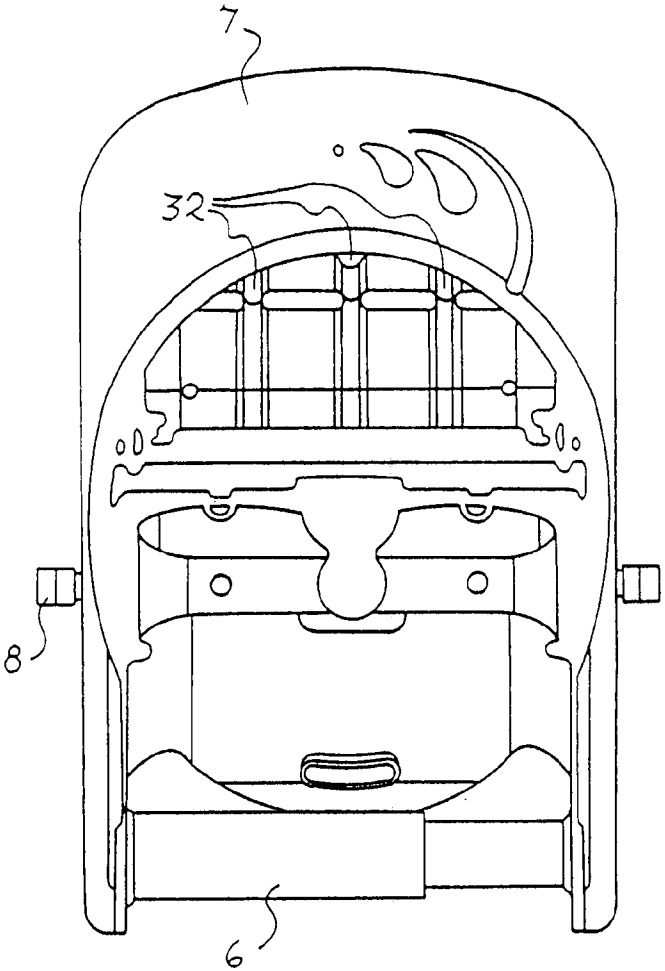
Figure 13:
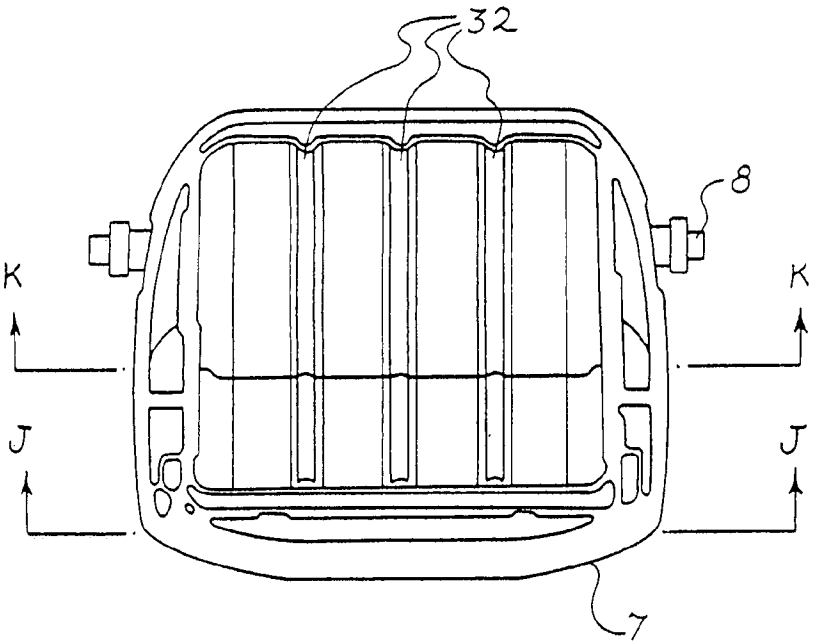
Figure 15:
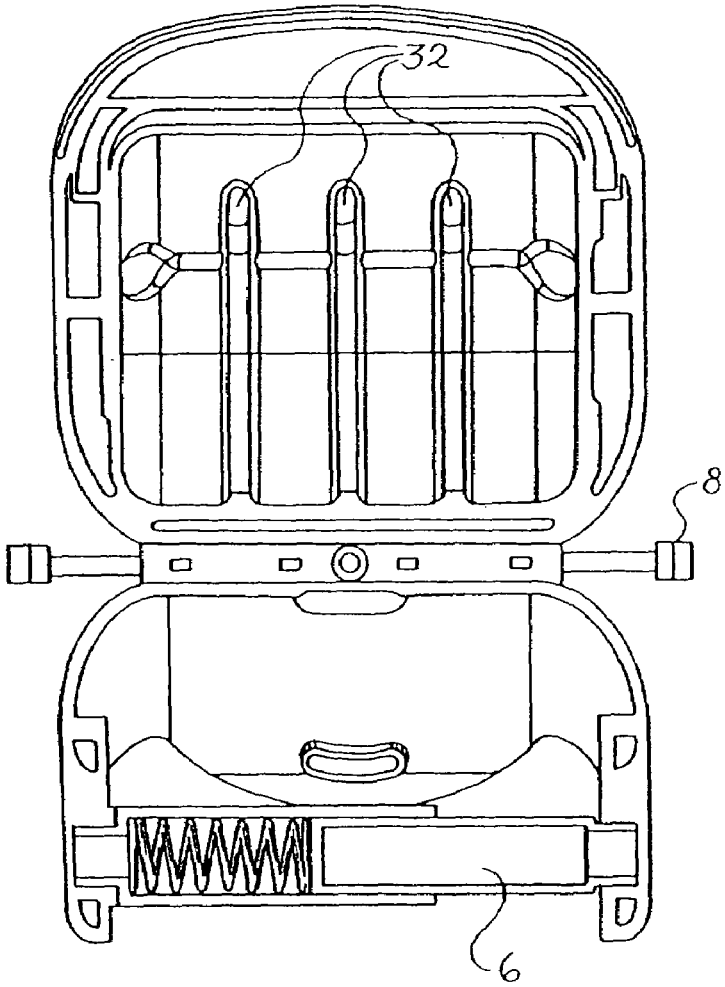

FIGS. 1 and 4–8 show the dispenser with the cover closed. In FIGS. 4 and 6, it can be seen most easily that the dispenser generally has a top 100, a side 101, a side 102, a back 103, a bottom 104 and a front 105. FIG. 2 show the dispenser and a cartridge in a exploded view. FIG. 3 show the dispenser assembled and in a fully opened condition. The fully opened condition provides access to screw 9.

The housing may be made from any suitable material, such as plastic, wood, ceramic, porcelain, glass, paper, metal, thermoplastic elastomers, or composite materials. For example, polypropylene, polyesters such as polybutylene terephthalate (Pbt), Pbt glass filled, Pbt 15% glass filled, fiberglass, carbon fiber, and acrylonitrile-butadiene-styrene (ABS) may be used to make the housing.

The housing may have different shapes and sizes. When the dispenser is intended for use in a home it is desirable that it be of a size that is similar to conventional bath tissue roller mounts. It is particularly desirable that the dispenser be as compact as possible for home use. Further if the cover is in the range of from about 4½ inches (114.3 mm) to 6⅞ inches (174.6 mm) in width it will be able to aesthetically fit in or mount to the vast majority of toilet paper holders that are in existing houses. Preferably the width of the cover may be greater than about 3 inches (76.2 mm), less than about 6 inches (152.4 mm), less than about 7 inches (177.8 mm), and less than about 8 inches (203.2 mm). The 4½ inches (114.3 mm) by 6⅞ inches (174.6 mm) size provides an added benefit of enabling one size of dispenser to be used in the vast majority of applications in the home. Smaller sizes may be desirable for certain applications or aesthetic reasons, such as a small bathroom. The dispenser and its components may have varied colors, such as the almonds and whites that are seen in porcelain bath fixtures or may have any other desirable color. When the housing is used for industrial or institutional purposes or in commercial applications it may be desirable to make the housing substantially larger and able to hold substantially more rolls of either or both wet and dry wipes and tissue.

Figure 1:
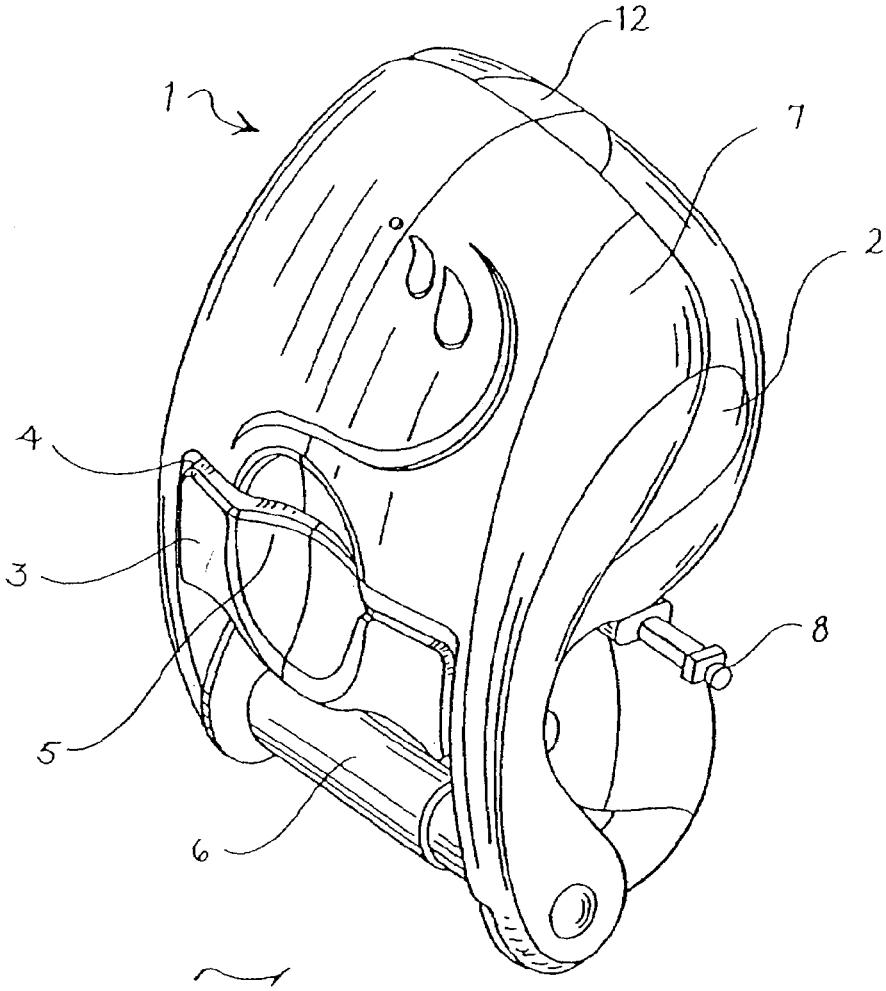

The housing may be configured as shown in FIG. 1 to mount onto or into a conventional wall mount toilet paper holder. It may also be mounted directly to a wall, for example by way of a screw, through mounting hole 30, or by other means of fixing the housing to a wall or surface, such as glue, nails, screws, rivets, magnetic attachments, staples, engaging brackets and pressure mountings against the sides of a conventional wall mount for toilet tissues. The housing also may have a lock 13 that engages a tab 12 on the cover to keep the cover closed, yet provide an easy way to open the dispenser. Various other ways to lock or fix the cover to the housing may also be employed. For example, a lock and key approach may be desirable in commercial applications or houses where there are small children present.

The housing may also have an opening 14 that is made to receive cover mounts 29. The opening 14 and the cover mounts 29 may further be configured to receive a conventional toilet tissue roller. The housing may further be configured to support a means of dispensing, storing, containing or mounting another product such as wipes, toilet tissue, or the like. For example, the housing may support a shelf which may in turn support a container of wet wipes having the same or a different composition from that of the wipes inside the housing. The housing may further have an opening 28 for receiving a pin 27 on the tray 3.

The cover 7 may be made of any similar material to the housing; it may be the same as or a different material from the housing. The cover may be clear or have a window for viewing the amount of wet wipes that remain in the dispenser. It is noted, however, that because the cover is in direct contact with the wet wipe, the cover forms the top of the cartridge when the cartridge is inserted into the dispenser and the cover closed, and wood or any other material that would support bacterial growth would not be favored. It is preferred that all materials that are in contact with the wet wipes be made from materials that discourage, or do not support bacterial growth.

Moreover, anti-bacterial agents, medicinal, botanical or skin and health agents may be added to the materials that are used to construct the components of the dispenser system, including by way of example the dispenser housing, the tray, the wiper blade, the wiper assembly, the cartridge, the cover and the gaskets. In particular any component that is in contact or associated with the wet wipes may have such an agent added to it.

The cover is designed to cooperate with the cartridge 11 to form a barrier to moisture loss from the wet wipes. The cover may also be designed to cooperate with other components of the dispenser system to form a moisture barrier. The dispenser can maintain wet wipes in a moist condition when fully closed for at least 1 day, for at least 2 days, for at least 5 days and for at least 14 days, and preferably for more than 14 days at room conditions of 73° F. (22.8° C.) and 50% relative humidity. The dispenser when fully closed can maintain at least about 15%, at least about 20%, at least about 25%, at least about 50%, and at least about 95% of the moisture of the wipes for a 14 day period at 73° F. (22.8° C.) and 50% relative humidity. These moisture retention values can be obtained with a tail of the wipe protruding through the gap, the tail having a length of not more than 1.5 inches (38.1 mm).

The cover may further be designed to cooperate with the cartridge 11, or other components of the dispenser system, to form a barrier to contamination of the wipes within the dispenser. Thus, the cover in cooperation with the cartridge, or other components of the dispenser system, may form a barrier to dirt, dust, mold spores and bacteria.

The space between the inner surface of the front cover and the surface of the lip of the cartridge may vary between about 2 mm and about 10 mm. In this way there is formed a dome above an open cartridge that at least partially covers that opening, which dome is preferably less than about 15 mm, less than about 10 mm, less than about 5 mm and ideally is less than about 2 mm above the lip of the cartridge. The height of the dome may also be measured from the surface of a full roll of wet wipes in which an additional 2 to 7 mm may be added to the height of the dome. Higher domes may also be employed, but such higher domes may be less aesthetically pleasing and may provide for greater amounts of evaporation or moisture loss from the wet wipes.

The cover may be provided with an inside rim 33 (see, e.g., FIG. 3) and a wiper 10 (see, e.g., FIGS. 2 and 3). The cover inside rim and wiper cooperate with the lip 31 of the cartridge. In this way when the cover is closed the inside rim is brought against the lip of the cartridge and the wiper is similarly brought against the tray including the guides, as well as the lip of the cartridge. In a further embodiment, the cover may be provided with a lip, and the cartridge may be provided with a rim to facilitate the cooperation.

The distance between the inside of the cover where the wiper is located and the tray may be less than the height of the wiper blade. Thus, in this configuration the wiper blade would be placed under compression against the lip, the tray, or the guides 16 or all of them depending on the position of the wiper. Here the wiper blade would exert pressure on the wet wipes. The wiper may also be positioned so that it contacts the wet wipe but does not exert pressure against it, or be positioned so that it is a short distance above the wet wipe. The amount of pressure that the wiper exerts on the wet wipe may vary depending upon several factors, including the purpose for the wiper, the material that the wiper blade is made from, the material that the wet wipe is made from and the material that the cartridge lip 31 is made from.

The tray 3 may be made from any similar material to the housing or cover, and it may be the same material or different material from those of components. The tray may have side walls 22, 23, 80 and 81. Walls 22 and 23 correspond to the sides of the dispenser, wall 80 corresponds to the top of the dispenser, and wall 81 corresponds to the bottom of the dispenser. The tray shown in the figures does not have a back wall, although one may be provided if desired. The side walls may be provided with recesses 24, 25, and 26. These recesses cooperate with protrusions 19, 20 and 21 on the cartridge (19 with 26, 20 with 24 and 21 with 25). In this way the cartridge is securely, yet easily removably held in the dispenser. The tray opening 15 is sized in relation to the cartridge (or the cartridge may be sized in relation to the tray opening) so that the cartridge can easily be slid into and out of the dispenser.

The tray and cartridge together result in a keyed type arrangement that allows the cartridge to be inserted fully or properly in only one orientation into the dispenser. Thus the two elements fit together in a manner similar to a lock and key. This assures that the roll of wipes will unwind from a predetermined orientation, i.e., from the bottom of the roll or the top of the roll. As is apparent from FIG. 2 the tray opening and cartridge are not symmetrically shaped. This asymmetry provides for the keyed arrangement. An object is considered symmetrical if there can be a plane which passes through the object such that the portions on either side of the plane are reflections of each other.

In the embodiment shown in FIG. 2 the asymmetry in the vertical plane is obtained by having a different number and location of protrusions and recesses on opposite sides. It is recognized that any suitable means to accomplish asymmetry may be employed, such as notches, tongue and groove, or the shapes of the opening and detents. For example, some of the cartridge walls may be flat while others are rounded, or the cartridge lip may be non-planar. Additionally, labeling or marking of the cartridge, the tray, or both can create the effect of asymmetry.

The housing may further have guides 16. The guides may be movable or fixed. The guides may have raised surfaces **16*a* and lowered surfaces 16*b*. These guides may be made from the same type of material as the housing. They may be integral with the housing. The guides and the housing may be one continuous piece of plastic. The guides may be designed to cooperate with the wiper to prevent or reduce the tendency of the wipe to skate to one side of the dispenser as the wipe is pulled out and torn off. The guides may also cooperate with the wiper to regulate and control the amount of drag. The tray may have barbs 71 to discourage the placement of wet wipes directly into the dispenser without the use of a protective package, a practice which could cause premature drying of the wet wipes or could allow the growth of bacteria and/or mildew in the wipes. An example of tray without barbs is seen at FIG. 26**.

The cartridge may be made out of any suitable material, such as plastic. It is preferable that the cartridge be made from a light weight, inexpensive, disposable and recyclable material. The cartridge has side walls 17, 18, 39 and 40 and bottom wall 41. The cartridge has a lip 31 that forms an opening at the top of the cartridge. The cartridge has ribs 32. The ribs may extend part way or all the way along the sides 39 and 40 and the bottom 41. The ribs 32 may cause grooves or indentations to form in the rolls, depending on the density of the roll and conditions of use. These grooves are not necessary to the use of the dispenser system. The curvature of the cartridge bottom is between 40 and 45 degrees, preferably between 42 and 44 degrees.

The cartridge may be any shape or size provided that it fits in or cooperates with the dispenser. For example a cartridge that would be useful for application in the home would have side walls 17 and 18 that are less than 105 mm and side wall 39 and 40 that are less than 134 mm.

Instead of protrusions 19, 20 and 21, the cartridge may have recesses at those locations, and the tray may have corresponding protrusions. Moreover, the cartridge may have ribs, like rib 32, along side walls 17 and 18.

The cartridge may have a lid or cover with a removable strip. Removal of this strip would result in a gap through which the wipes can be dispensed. In this configuration, it may be useful to attach the tail of the wipes to the strip. In this way, removal of the strip facilitates the threading of the wipes through the gap. The cartridge may also have a removable seal over the cover.

The container for the wet wipes may also be flexible. A flexible package made of plastic, metal foil, paperboard or combinations thereof may be used to seal the wipes in a wrapper or may be configured as a pouch with a removable cover. Any material and configuration that prevents the loss of moisture from the wet wipes may be used to package the wipes. A removable cover may contain a removable strip to facilitate dispensing of the wipes. The cover may also contain a lip to cooperate with the cover inside rim and the wiper. The combination of the wipes and the container may be the same size as or smaller than the cartridge so as to fit within the tray.

Figure 16:
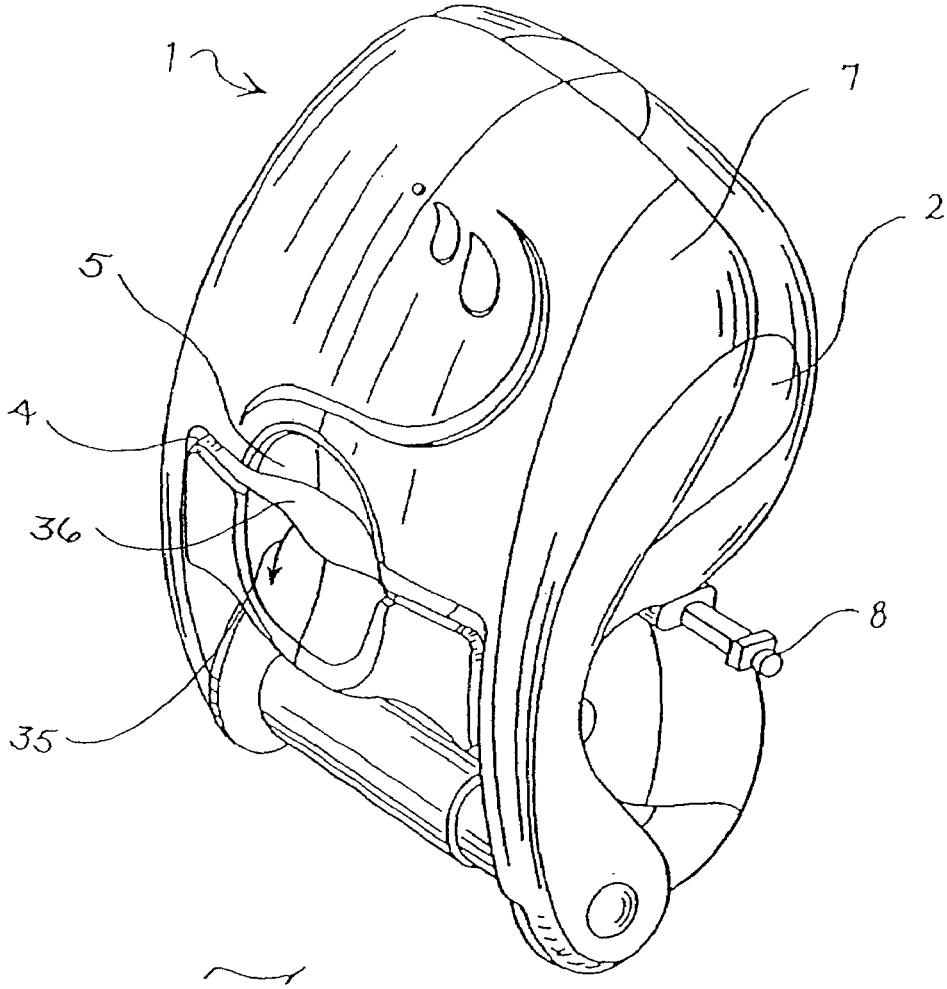

FIG. 16 shows a dispenser in the closed condition with a tail of a wet wipe 36 protruding from gap 4 into the finger hold indentation that is formed by recess 5. In use the tail of the wet wipe would be grasped and pulled generally in the direction of arrow 35 causing the roll to unwind and the wipe to be dispensed from the dispenser. In use the wet wipe may also be subjected to forces tangential and perpendicular to the direction of arrow 35. If these forces occur the guides and the wiper help to prevent the wipe from skating to one side of the gap and bunching up or binding.

Figure 17:
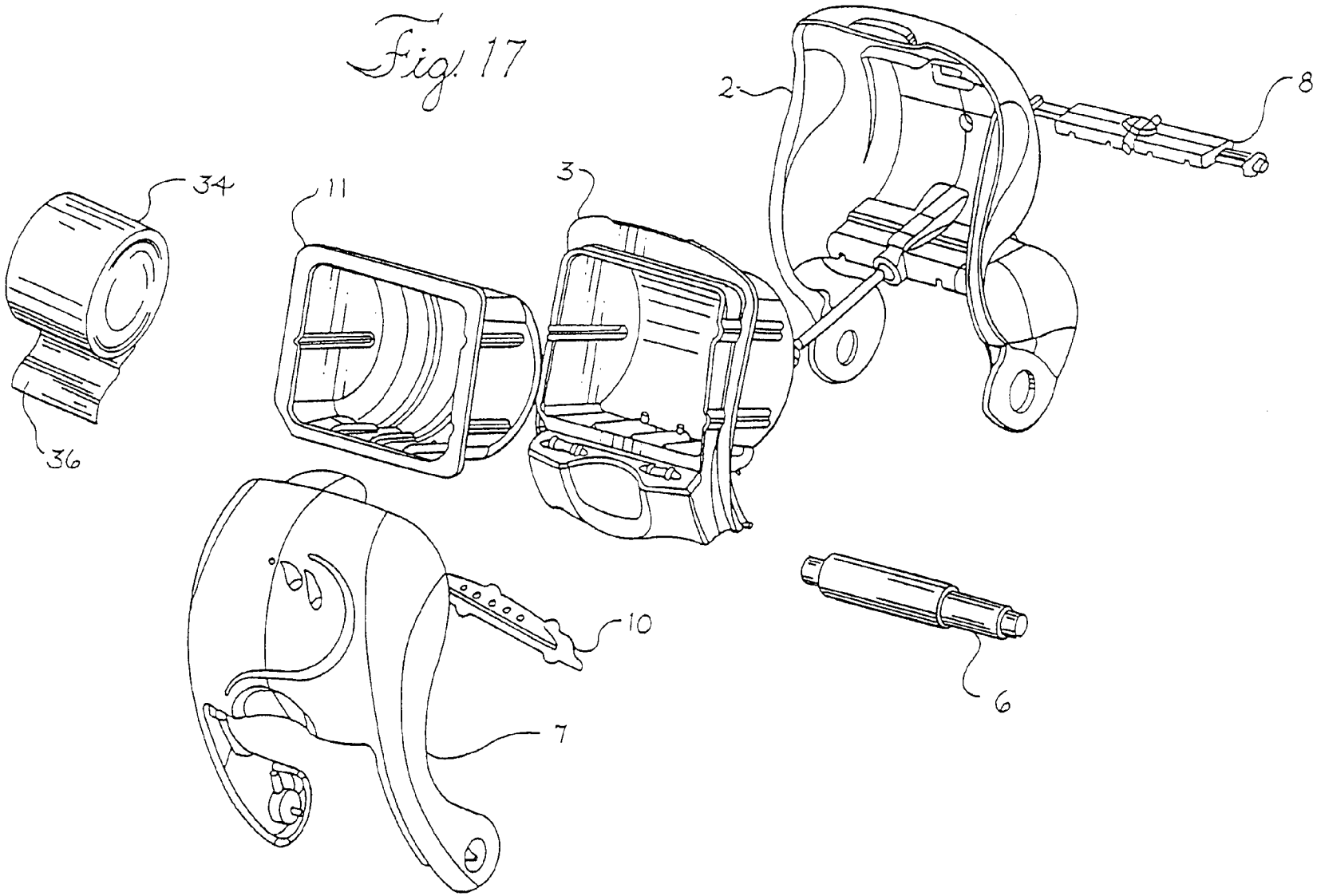
Figure 22:
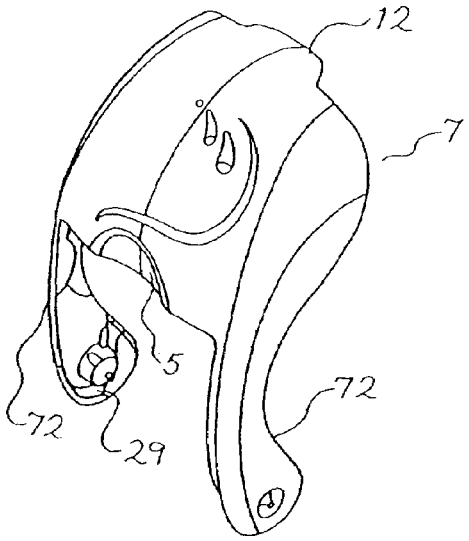
Figure 24:
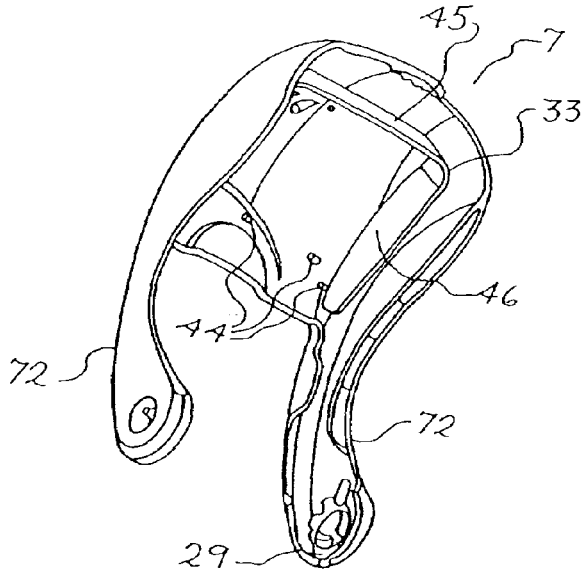
Figure 23:
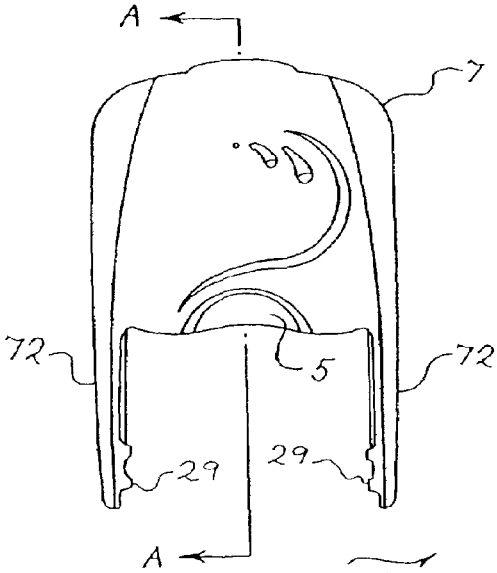
Figure 25:
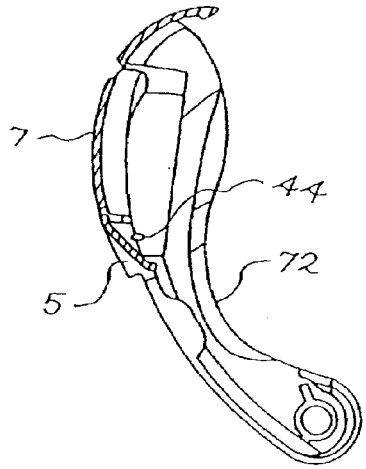

FIG. 17 is an exploded view of a dispenser, cartridge and roll of wipes 34 showing the relationship of these components.

FIG. 18 shows a roll of wipes 34 that has a tail 36 and further defines the axis of the roll as 37. Rolls useful with this dispenser or as part of a dispensing system may contain from as little as a few linear inches (or cm) to more than 450 linear inches (11.43 m), to more than linear 600 inches (15.24 m) to more than a thousand linear inches (25.40 m) of wet wipes. The rolls may have a web of material that may have any number of sheets. Usually, the sheets are separated by perforations that enable the sheet to be easily torn from the web but are strong enough that they will not separate while the web is being pulled from the dispenser. An example of a roll that is particularly useful for applications in the home is one that has a diameter of about 2 inches (50.8 mm) to about 3 inches (76.2 mm), of about less than 5½ inches (139.7 mm), and preferably has a diameter of about 3 inches (76.2 mm) and more preferably of about 2⅞ inches (73.0 mm). This roll has from about 400 linear inches (10.16 m) of wipes to about 1000 linear inches (25.40 m) of wipes. Without limitation, each sheet length may be from about 3 inches (76.2 mm) to about 10 inches (254.0 mm) and preferably are about 4.5 inches (114.3 mm). This roll may further have a density of from about 0.3 g/cc to about 1 g/cc, from about 0.5 g/cc to about 1 g/cc and preferably about 0.62 g/cc. A particular example of a roll may be one having a diameter of about 2 inches (50.8 mm) and containing about 450 linear inches (11.43 m) of wipe. Another particular example of a roll may be one having a diameter of about 3 inches (76.2 mm) and containing 450 linear inches (11.43 m) of wipes.

The preferred form of wet wipes for use with the dispenser system is a solid coreless roll as shown in FIG. 18. It is to be understood, however, that cored rolls (hollow cores, solid cores and partially solid cores), hollow coreless rolls, and stacks of sheets may also be used in the dispenser system. When density values are referred to herein, it is for the density of the roll and this would exclude any void, for a coreless hollow roll, or space occupied by a core for a cored roll.

FIG. 19 shows the roll 34 as it is placed in a cartridge in a dispenser. The spiral line 38 is intended to represent the manner in which the roll is wound and depicts in that configuration a roll that is being unwound from the bottom. That figure further shows the relationship of the wiper 10 to the wet web. FIG. 20 shows the roll 34 in cartridge 11, with spiral line 38 indicating the wind of the roll. This figure shows the relationship of the roll and the ribs 32. As can be seen from this figure the roll is lifted off of the side and bottom walls of the cartridge by rib 32. Thus, the amount of surface area of the roll that is in contact with the cartridge is reduced. This in turn reduces the drag that the roll experiences from friction with the cartridge when the roll is turned.

FIG. 21 shows a portion of a cartridge 11, the lip 31 of the cartridge, and the side walls 39 and 40. The angle at which the cartridge is positioned has an effect on how well the dispenser will perform. The angle will have a tendency to increase or reduce the drag associated with pulling the wipe out. It will have an effect on the amount of siphoning, wicking or drying that may take place in the wet wipe. It may also have an effect on how the roll acts as it is unwound, becoming smaller and smaller in the cartridge. The angle of the cartridge can be measured by the angle that the lip 31 forms with a true vertical axis, shown as 42. For a dispenser system as shown in FIGS. 1–19, the angle 43 that the lip 31 has with a true vertical axis 42 should be from about 10 degrees to about 80 degrees, from about 20 degrees to about 70 degrees, at least greater than 20 degrees, at least smaller than 60 degrees, and preferably about 30 degrees.

Further the angle may be selected such that it balances the forces between the peel forces associated with unrolling the roll and the weight of the roll forcing it down against the ribs. Thus the wipe can be unrolled without having excessive movement of the roll within the cartridge, which in turn overcomes the tendency of the roll to translate toward the gap and bind or jam the dispenser. Additionally, the selection of the angle may play a role in reducing the drying of the wet wipe. As the angle 43 is increased the difference between the height of the top of the roll and the tail is decreased, thus decreasing any siphoning driving force.

FIGS. 22 through 25 show various views of an example of a cover. In this example the cover 7 has cover mounts 29, a recess 5 for forming part of a finger hold indentation, an inside rim 33, which has a top inside rim section 45 and side inside rim sections 46 (of which only one can be seen in FIG. 24), leg sections 72, and posts 44. In this example the posts are used to connect the wiper to the cover.

FIGS. 26 through 28 show an example of a tray 3*a*. In this example the tray has an opening 15*a* with 3 recesses on both sides. The tray has guides that are rollers 47.

In a further example of the tray, the tray is fixed to the housing. This may be accomplished by having the housing and tray being made out of a single piece of material or having the housing and tray joined together by a permanent bonding means, such as welding, heat bonding or gluing. In yet a further example the tray may be attached to the housing so that is cannot rotate with respect to the housing, yet still may be removable.

Figure 29:
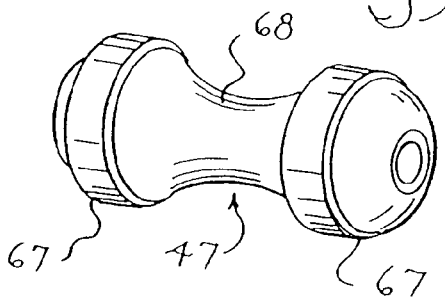
Figure 30:
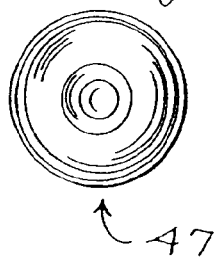
Figure 31:
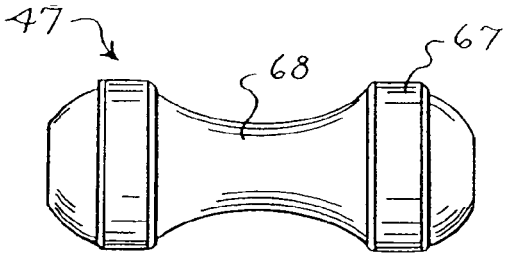

FIG. 29 shows the rollers 47 used in the tray 3*a* shown FIGS. 26–28. The rollers have raised surfaces 67 and lowered surfaces 68. The raised and lowered surfaces of the rollers as well as any guide may also be a ridge or a rim. As the raised or lowered surfaces become narrower, i.e., become sharper, care must be taken not to cut the wet web.

Wiper blades may be made out of any flexible material, such as thermoplastic elastomers, foam, sponge, plastic, or rubber having a shore A durometer hardness value ranging about 0 to 80, from about 15 to about 70 and preferably from about 30 to about 60. It is further preferred that the wiper blades be made from a material that will form a good moisture and contamination barrier. Examples of preferred types of material are SANTOPRENE®, Kraton®, silicone, or styrene ethylene/butylene styrene (SEBS). The wiper blade is designed to function with the guides and the tray and to a limited extent the lip of the cartridge. Depending on the placement of the wiper, it could have greater or lesser interaction with these components of the dispensing system. The gap between the end of the wiper blade and the tray may be varied depending upon the thickness of the wet wipes and how much drag is need for the dispensing system to function as desired. The wiper blade can help to hold the tail of the wipe in place and thus keep the tail from falling back through the gap and into the cartridge. The wiper blade material has a Gurley stiffness value (ASTM D 6125-97) between about 100 mg and 8000 mg, preferably between about 200 mg and 6000 mg, and more preferably between about 400 mg and 3000 mg.

The force applied to the wipe by the wiper blade when pulling the wipe from the dispenser should not be greater than the tensile strength of the wipe in the non-perforated region and not greater than the perforation tensile strength of a perforated wipe. If the wipes are made such that they are dry in storage and become wet during use, the blade may be configured to exert pressure on the wipe. In this case, the dispensing of a sheet or sheets causes sufficient shear to be applied to the wipe to permit the moisture to be released. For example, this force or shear may be sufficient to cause microcapsules of fluid to burst or may be sufficient to rupture a protective emulsion which contains the fluid.

Figure 2A:
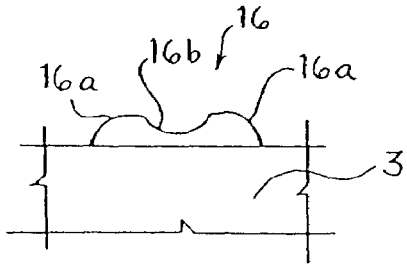

FIGS. 32 through 37 show an example of a wiper assembly. In this example the wiper assembly 10 comprises a chassis 48, and a blade 50 that has fingers 49. In this example the fingers are designed to cooperate with the lowered surfaces 16*b* (FIG. 2A) of the guides on the housing. In this example the blade is made of SANTOPRENE® and the chassis is made of polypropylene.

Figure 38:
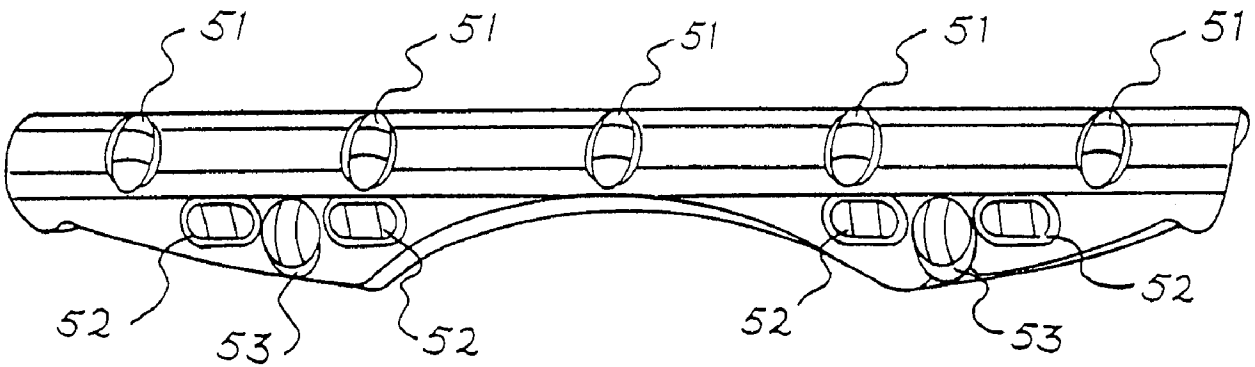
Figure 39:
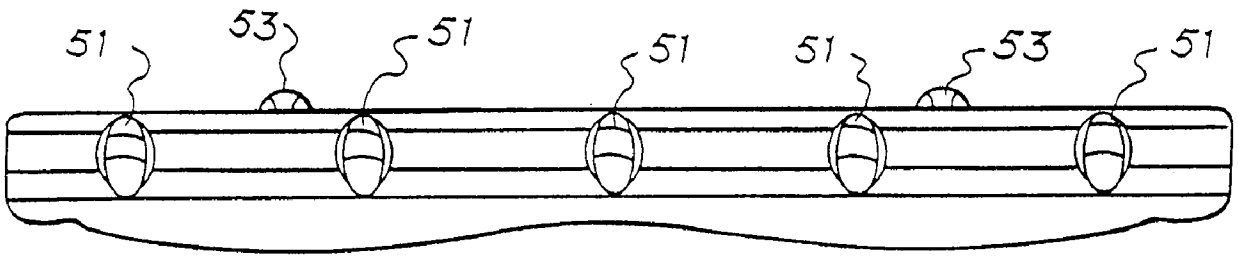
Figure 42:
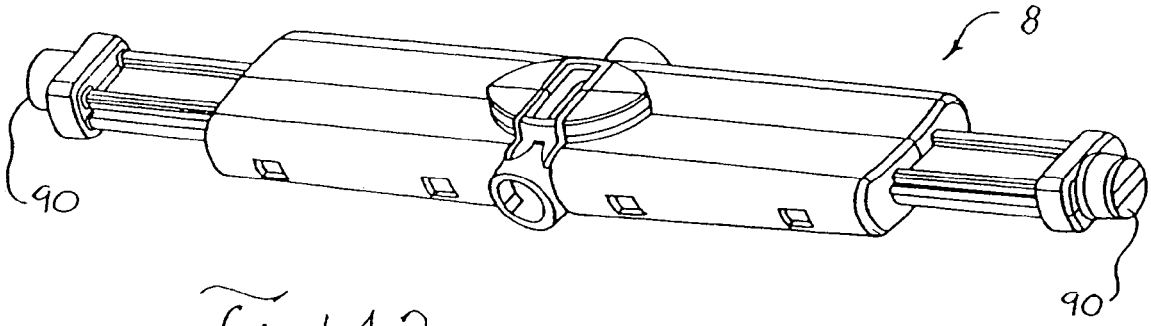

FIGS. 38 through 39 show an example of a wiper blade. In this example the wiper blade is formed of a single piece (see FIG. 38) of material that is folded over to form the wiper blade (see FIG. 39). The wiper blade has raised portions 51 that reduce the amount of surface area of the wiper blade that contacts the sheet and raised areas 53 and lowered areas 52 that cooperate with the raised and lowered areas of the guides.

FIGS. 62 to 65 illustrate dispensers 1 that have a rounded member 95 or rounded ridges 96. These components are shown as being part of or attached to the wiper blade assembly 99 and adjacent the wiper blade 74. These components prevent or reduce the tendency of the roll from binding in the gap as the size of the roll decreases.

FIGS. 57 through 61 show an example of a wiper assembly. In this example the wiper comprises a chassis 73, and a wiper blade 74 (74*a* shows sections of blade engaging and protruding through the chassis) that has fingers 75. In this example the fingers are designed to cooperate with the lowered surfaces of the guides 16 in the dispenser. In this example the blade is made of SANTOPRENE® and the chassis is made of polypropylene. This embodiment contains raised or thicker areas 97 of the wiper. These raised areas cooperate with the guides 16 on the tray.

Figure 40:
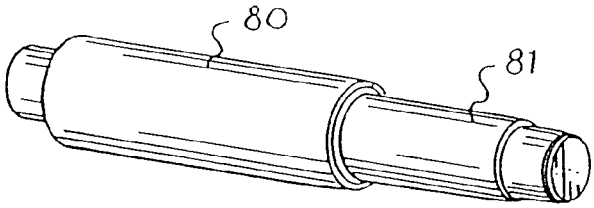
Figure 41:
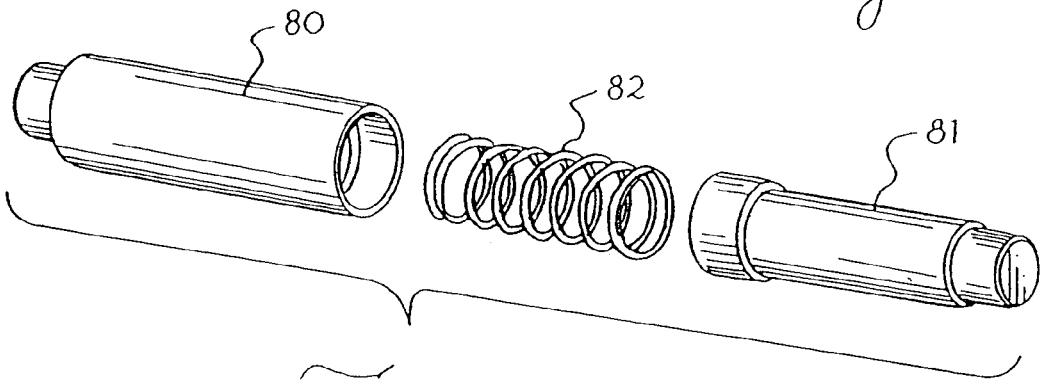
Figure 33:
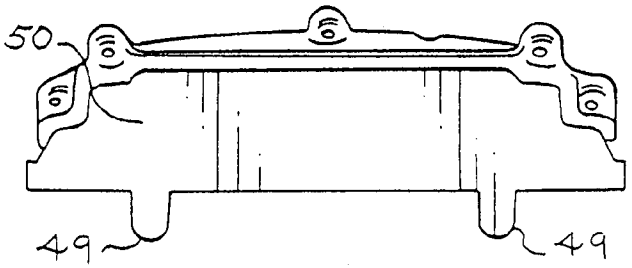
Figure 37:
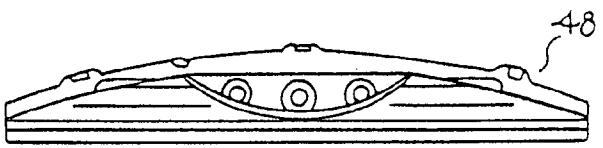
Figure 32:
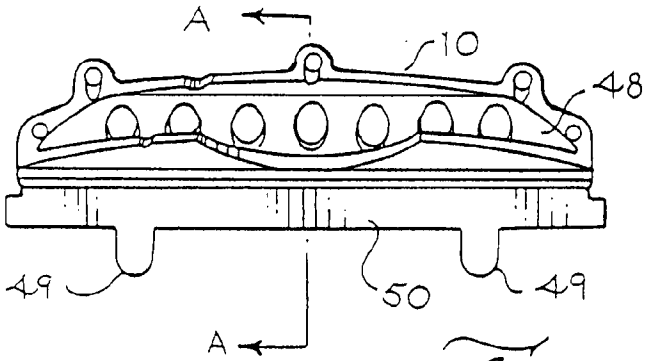
Figure 35:
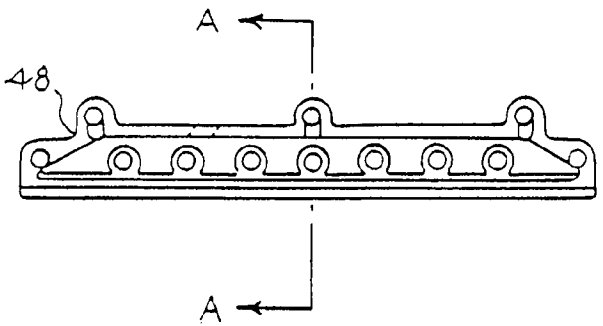
Figure 34:
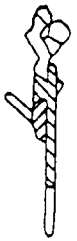
Figure 36:
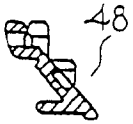
Figure 55:
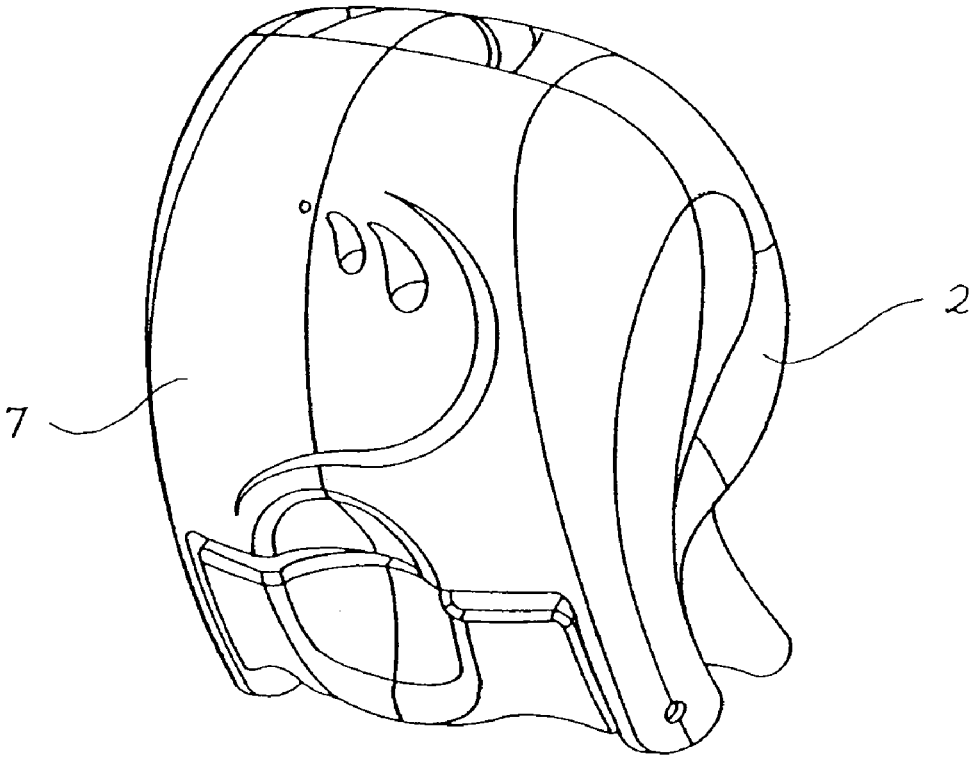
Figure 56:
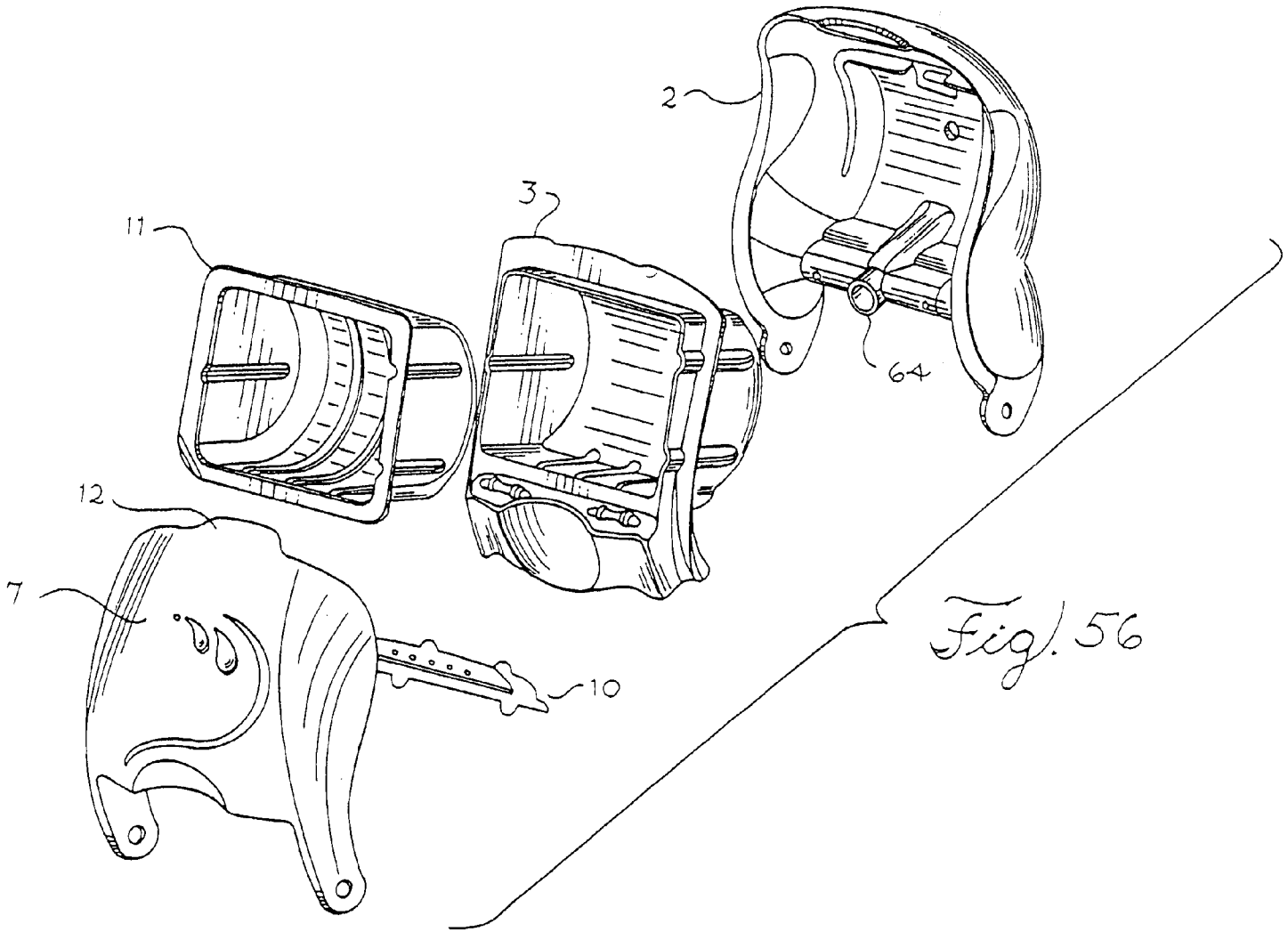
Figure 58:
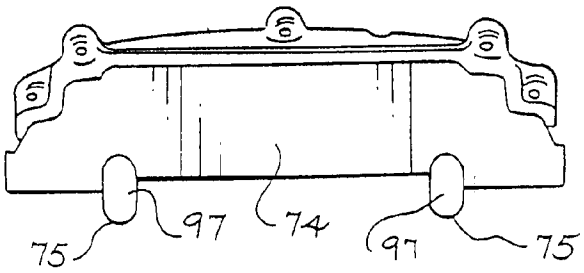
Figure 61:
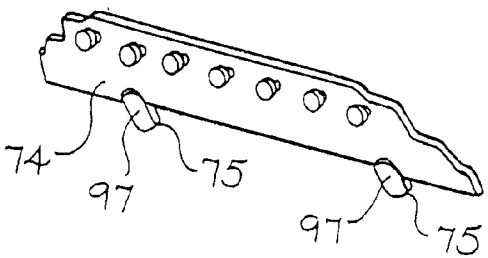
Figure 60:
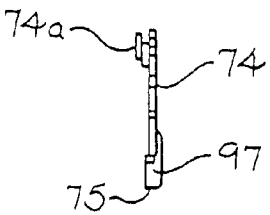
Figure 57:
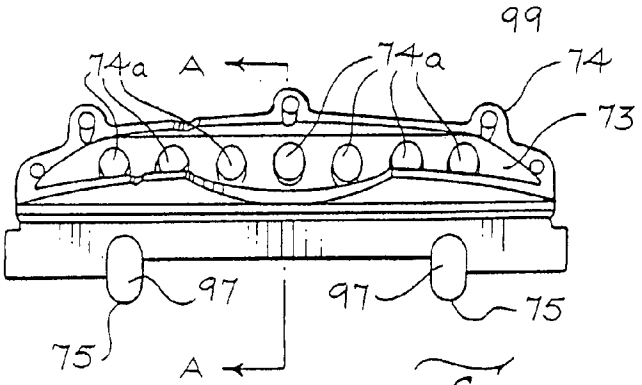
Figure 59:
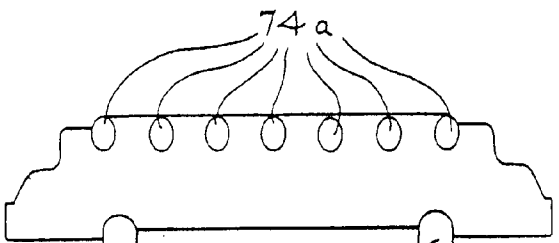
Figure 62:
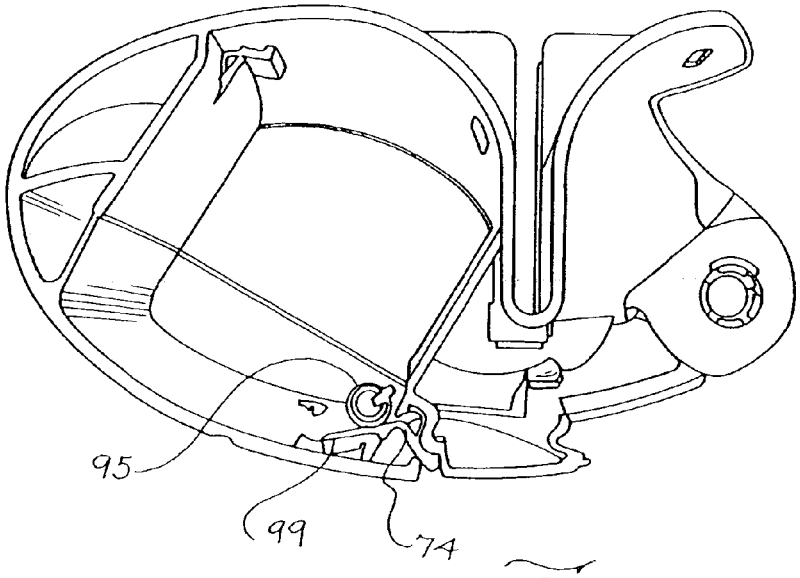
Figure 63:
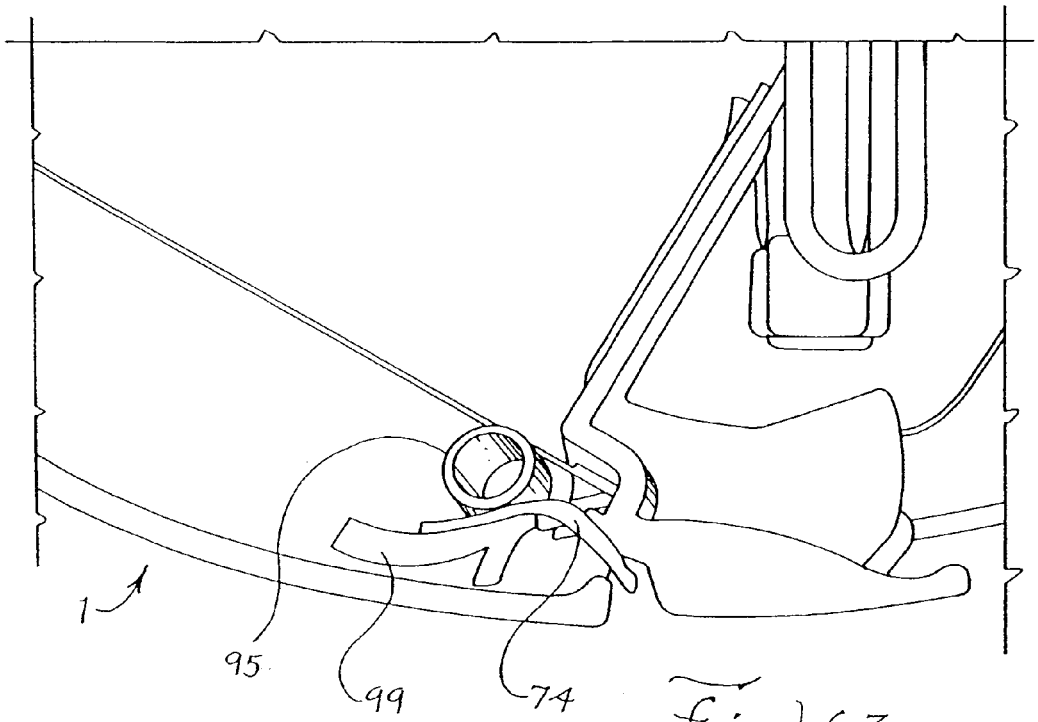
FIG. 63 is a cross-sectional view of a portion of a dispenser.

FIGS. 40 through 41 show an example of a roller bar for toilet tissue. This example comprises a first roller housing 80, a second roller housing 81 and a spring 82. FIGS. 55 through 56 show other embodiments of the dispenser.

Figure 44:
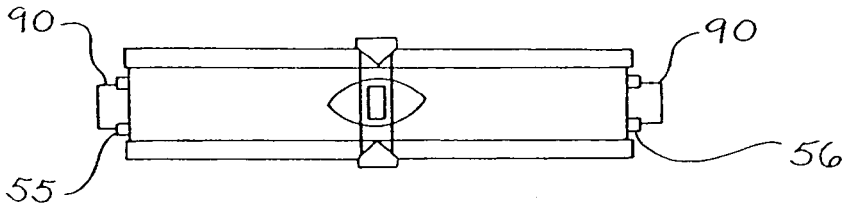
Figure 45:
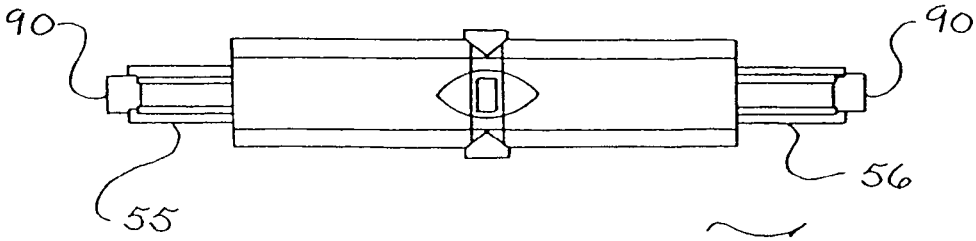
Figure 43:
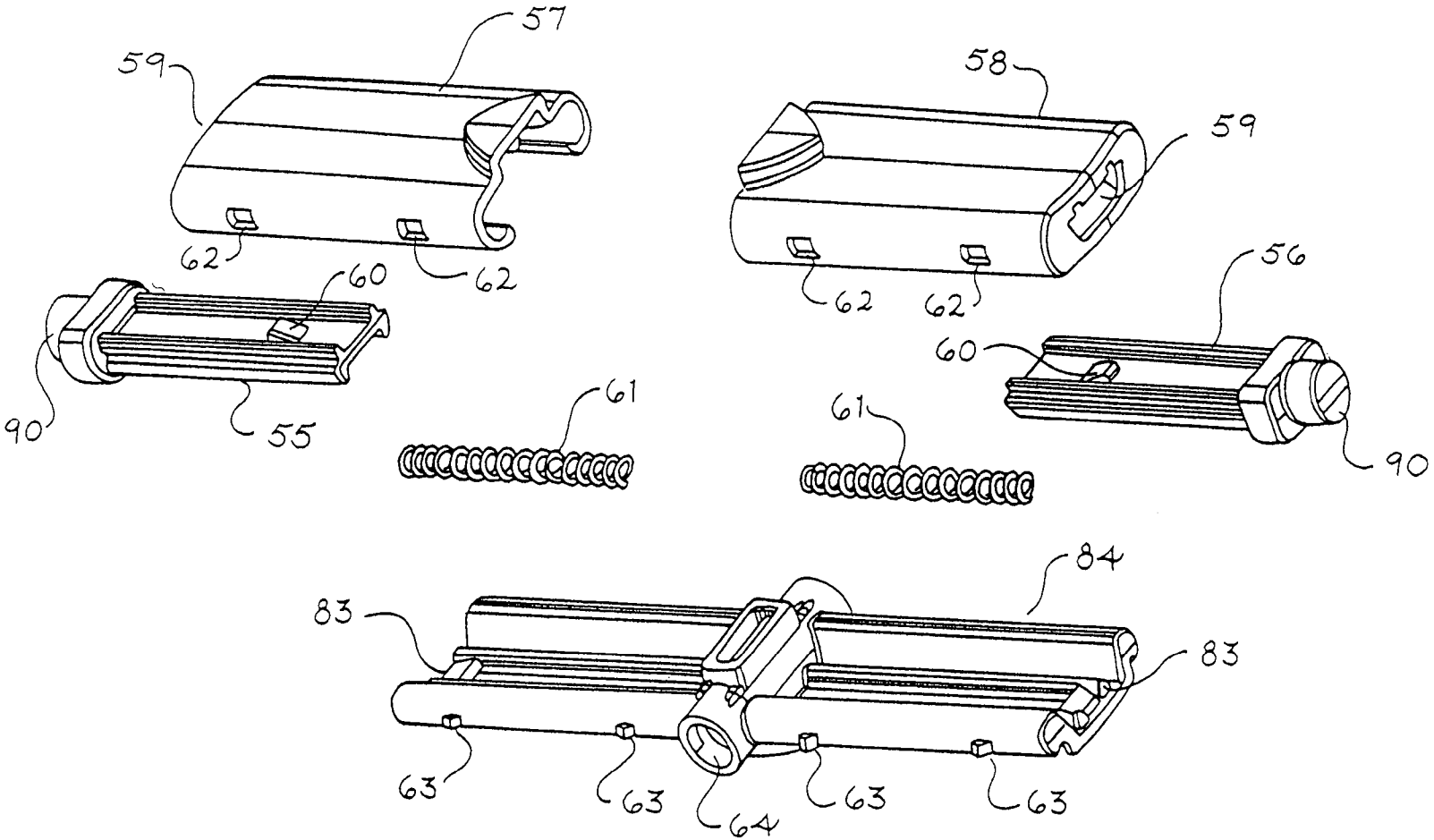

FIGS. 42 through 45 show an example of a mounting assembly. This mounting assembly comprises slide arms 55 and 56, housings 57 and 58, end openings 59, and springs 61. The slide arms have stops 60 that cooperate with stops 83 to limit the maximum longitudinal extension of the slide arms. The mounting assembly has a third housing 84 that has tabs 63 that cooperate with openings 62 to secure the housings 57 and 58 to housing 84. Housing 84 further has a threaded passage 64 for receipt of a screw. FIG. 44 shows the mounting assembly with the slide arms in a retracted position, while FIG. 45 shows the mounting assembly with the slide arms in an extended position. In one embodiment, the length of the mounting assembly in the retracted position is about 3.5 inches (88.9 mm), and the length of the mounting assembly in the extended position the length is about 8 inches (203.2 mm). Preferably the length of the mounting assembly in the retracted position is about 5 inches (127.0 mm), and the length of the mounting assembly in the extended position the length is about 6.5 inches (165.1 mm). The three housing design may also be simplified into a two housing embodiment or a single housing embodiment. In the two housing embodiment, top and bottom or side and side halves are fixed together to hold the spring and slide arms.

The assembly is held in place by having the ends out the side arms positioned in holes in the object that the dispenser is to be attached to, for example the holes in a toilet paper dispenser mounted into a wall. The springs keep the slide arms extended and thus hold them in the holes. A screw is then inserted through the dispenser and the passage 64 and tightened down, forcing the end engagement surfaces 90 against the wall of the holes in the toilet tissue dispenser.

FIG. 66 depicts a conventional bath tissue holder 85 that is the partially recessed type, having posts 86. FIG. 67 depicts a conventional bath tissue holder 85 that is not recessed and having posts 86 and a roller 6. FIG. 68 illustrates the holder of FIG. 67 with the roller removed and a mounting assembly 8 engaged with the post 86. In actual use the mounting assembly would be joined with a dispenser, as shown for example in FIG. 2.

The mounting assembly should be made out of material that is strong enough to withstand the forces that are placed on it to hold the dispenser in place. The material should have enough strength to withstand the forces that the screw will place on the treaded passage. Examples of materials that may provide these features and be used to make the mounting assembly are 15% or more glass filled Pbt, ABS or any material having similar strength properties.

FIGS. 46 to 50 show an example of a screw 9 that cooperates with a mounting device, such as the example shown in FIGS. 42–45. The screw should be made of material that meets the same strength requirements as set out for the mounting assembly. In this example the screw has a thread design that requires 6 turns to move it 1 inch (25.4 mm). Standard ACME conventional screw threads require 23 turns to move it 1 inch (25.4 mm). This thread design provides greater ease for the user to attach the dispenser because it requires less turns of the screw to do so. In this example the screw additionally has a large head, with a groove 65 and grips 66. The groove can fit a coin or screwdriver. The larger head of the screw and the groove, however, are not necessary, although they may be preferred to provide greater ease to install the dispenser system. The screw may further be provided with a lock nut or jam nut near the head to prevent loosening of the screw after it is tightened.

Alternative mountings may also be employed. These mountings may be fixed or removable. They may include by way of example such fastening systems as cable ties, wing nuts, anchor bolts, click and grooves and snap and lock mechanisms.

Figure 51:
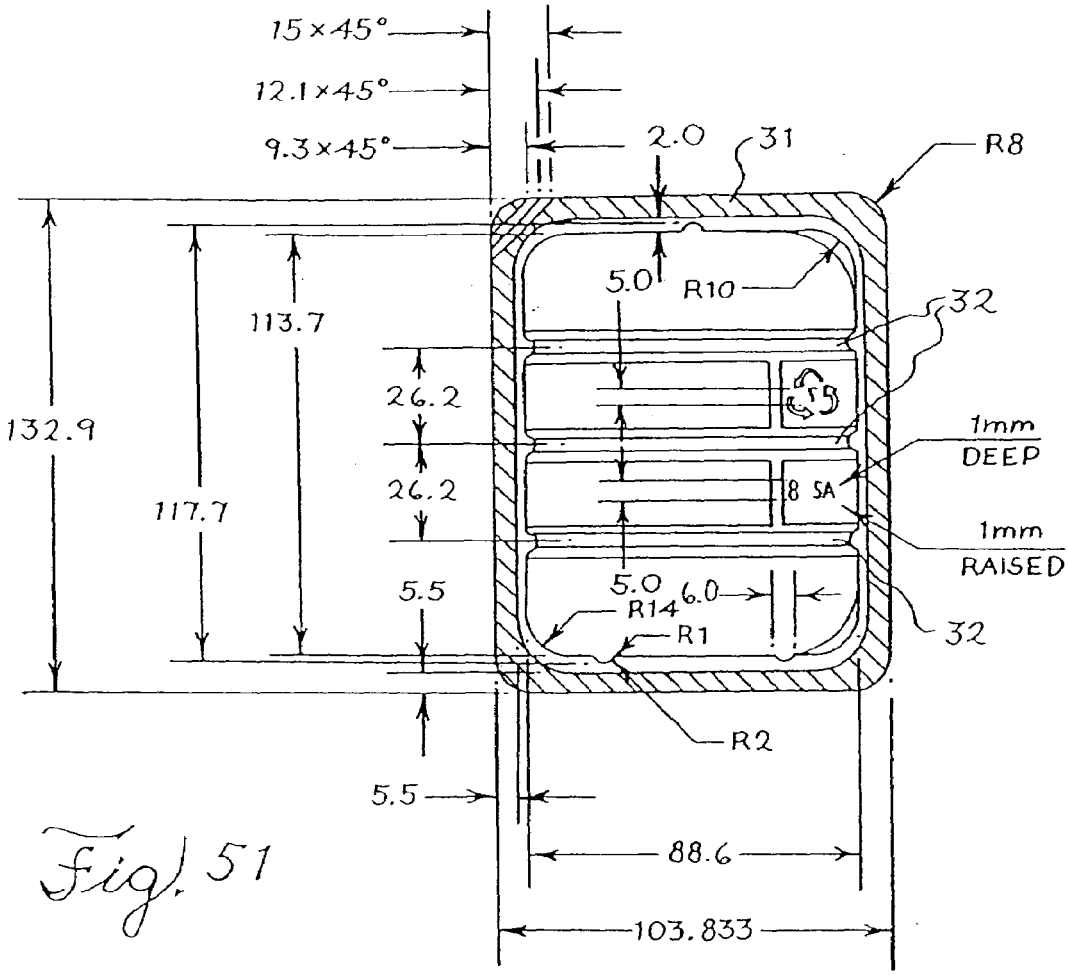
Figure 52:
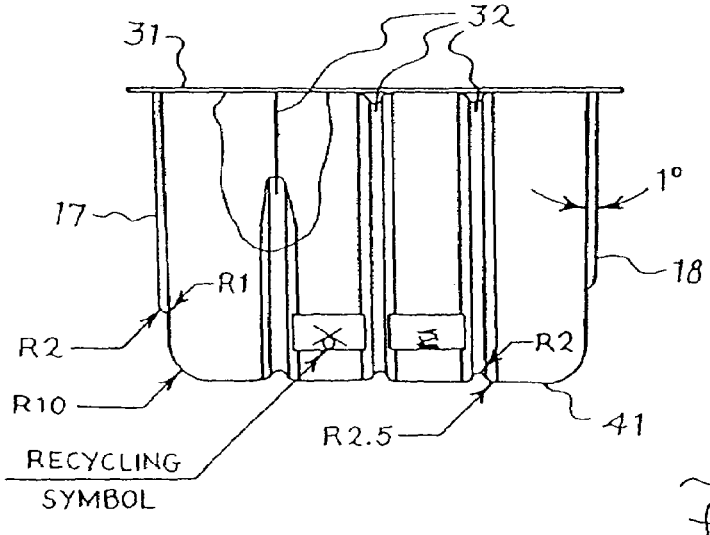
Figure 53:
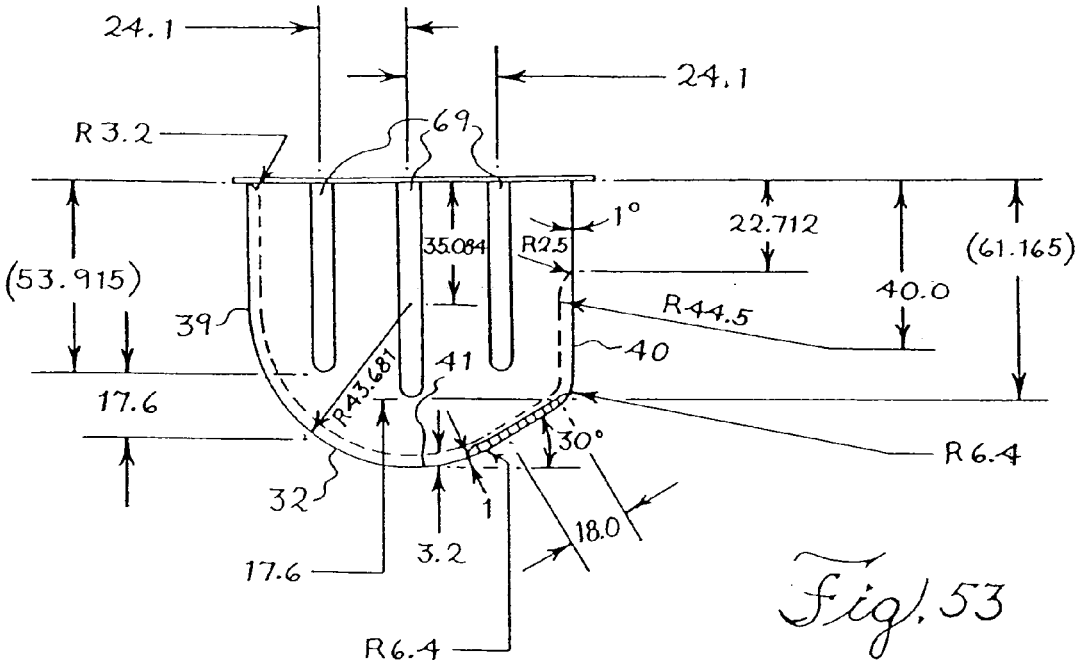

FIGS. 51–53 show an example of a cartridge. In this example the cartridge has protrusions 69 on its side walls.

Figure 54:
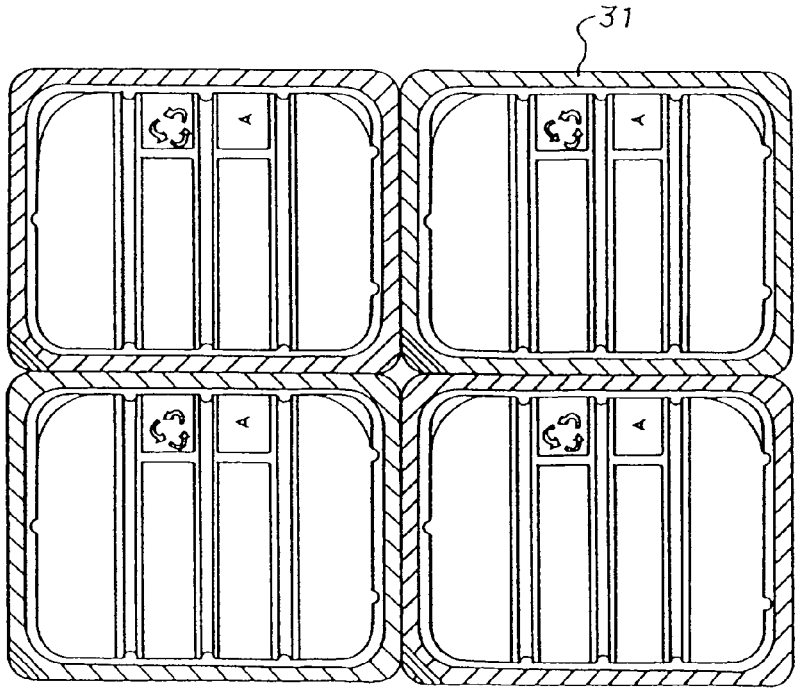

FIG. 54 shows an example of a package of cartridges. In use this package would be filled with rolls of wet wipes, one for each cartridge. The cartridges would than be sealed, by placing a totally or partially removable cover over the lips 31. The seal is preferably moisture and bacterial resistant. The consumer would then purchase the package and remove a cartridge, open the dispenser and place the cartridge in the dispenser. The top of the cartridge or the slit in the cover can be removed either before placing the cartridge in the dispenser or after it is inserted in the dispenser. The end of the roll of wet wipes is then pulled out and over the tray and guides and the cover is then closed, thus providing an efficient system for dispensing wet wipes.

This dispensing system is useful with all types of wipes, for example wipes which are disclosed in application Ser. Nos. 09/564,449; 09/564,213; 09/565,125; 09/564,837; 09/564,939; 09/564,531; 09/564,268; 09/564,424; 09/564,780; 09/564,212; 09/565,623 all filed May 4, 2000, and application Ser. No. 09/223,999 entitled Ion-Sensitive Hard Water Dispersible Polymers And Applications Therefore, filed Dec. 31, 1998 the disclosures of which are incorporated herein by reference.

In addition, the wipes can be dry wipes which become moist during use. The moisture in these wipes is encapsulated so that the wipes are dry during storage and handling. The forces on the wipe during use cause the moisture to be released, resulting in a wipe which is wet. The moisture in these wipes may be encapsulated in a membrane, in a micelle, in a microcapsule, in an emulsion which is at least partially solid, or in any other material which allows the dry wipe to become moist during use. An example of this type of wipe is described in World Patent Publication Number WO 99/01536, published Jan. 14, 1999, the disclosure of which is incorporated herein by reference.

Such wipes containing encapsulated agents, like wetting agents or solutions, have a dry feel. That is, the wipes when handled have the same dryness as ordinary tissue or toweling. A dry feel would include a sheet having moisture absorbed from the atmosphere at normal room conditions such as would be found in the home of a consumer. The contained agents may be water, solutions, or emulsions, and may contain cleaning agents such as surfactants or detergents, therapeutic agents such as moisturizer or medication, fragrances, abrasives, other encapsulating agents and combinations thereof. Also, the wipes may contain more than one type of contained agent. Different types of contained agents may function as an effective combination for wetting, cleaning, or treating a surface. Thus, by way of example, the force exerted by the wiper assembly is such that it breaks or ruptures the structure encapsulating the moisture, making the wipe moist as it is dispensed.

We claim:

1. A dispensing system for wipes
a dispenser;
a wiper blade;
a wipe, the wipe encapsulating a contained agent within the wipe; and
a gap in the dispenser;
wherein the wiper blade is configured to exert pressure on the wipes sufficient to rupture or release the contained agent from within wipes when the wipe is pulled through the gap.

2. The dispensing system of claim 1, wherein rupture or release of the contained agent moistens the wipe.

3. The dispensing system of claim 1, wherein the agent is contained in an emulsion.

4. The dispensing system of claim 1, wherein the agent is contained in microcapsules.

5. The dispensing system of claim 1, wherein the agent is contained in a membrane.

6. The dispensing system of claim 1, further comprising a mounting assembly.

7. The dispensing system of claim 6, wherein the dispenser is secured to a conventional dry bath tissue dispenser and at least one surface by means of the mounting assembly.

8. The method of claim 1, wherein the agent comprises water.

9. The dispensing system of claim 1, wherein the agent is a structure encapsulating water, wherein the structure is ruptured when the wipe is pulled through the gap.

10. The dispensing system of claim 1, wherein the wiper blade is made of flexible material.

11. The dispensing system of claim 1, wherein the wiper blade comprises raised portions reducing the amount of surface area of the wiper blade contacting the wipes.

12. A method of dispensing a wipe from a dispenser comprising:
pulling a wipe from a dispenser, the wipe encapsulating a contained agent within the wipe;
wherein the pulling results in the dispenser exerting a force on the wipe such that the contained agent is ruptured or released from within the wipe.

13. The method of claim 12, wherein release of the contained agent moistens the wipe.

14. The method of claim 12, wherein the agent is contained in an emulsion.

15. The method of claim 12, wherein the agent is contained in microcapsules.

16. The method of claim 12, wherein the agent is contained in a membrane.

17. The method of claim 12, wherein the dispenser comprises a wiper blade.

18. The method of claim 17, wherein the force is exerted by the wiper blade.

19. A dispensing system for wipes a dispenser;

a wiper blade;

at least one tray, guide, or lip;

wipes, the wipes comprising a contained agent; and a gap in the dispenser, wherein the wiper blade is compressed against the at least one tray, guide, or lip exerting pressure on the wipes sufficient to rupture or release the agent.

20. The dispensing system of claim 19, wherein the wiper blade extends across the gap.

21. The dispensing system of claim 19, wherein rupture or release of the contained agent moistens the wipe.

22. The dispensing system of claim 19, wherein the agent is contained in an emulsion.

23. The dispensing system of claim 19, wherein the agent is contained in microcapsules.

24. The dispensing system of claim 19, wherein the agent is contained in a membrane.

25. The dispensing system of claim 19, wherein the agent comprises water.

26. The dispensing system of claim 19, wherein the wiper blade is made of flexible material.

27. The dispensing system of claim 19, wherein the wiper blade comprises raised portions reducing the amount of surface area of the wiper blade contacting the wipes.

28. The dispensing system of claim 19, comprising at least one wipe, wherein the at least one wipe comprises two portions:

a first portion inside the dispenser; and a second portion outside the dispenser;

wherein the first portion comprises a structurally intact contained agent within the wipe and the second portion comprises a contained agent ruptured or released from within the wipe, thereby wetting the second portion.

29. The dispensing system of claim 19, further comprising a mounting assembly.

30. The dispensing system of claim 19, wherein the dispenser is secured to a conventional dry bath tissue dispenser and at least one surface by means of the mounting assembly.

* * * * *

UNITED STATES PATENT AND TRADEMARK OFFICE

CERTIFICATE OF CORRECTION

PATENT NO. : 7,188,799 B1
APPLICATION NO. : 09/659306
DATED : March 13, 2007
INVENTOR(S) : Jeff Lindsay et al.

It is certified that error appears in the above-identified patent and that said Letters Patent is hereby corrected as shown below:

Column 12, in claim 1, line 24, after "agent from within" delete "wipes" and substitute --the wipe-- in its place.

Signed and Sealed this

Nineteenth Day of June, 2007

JON W. DUDAS
*Director of the United States Patent and Trademark Office*